US008005381B2

(12) United States Patent
Shimizu

(10) Patent No.: US 8,005,381 B2
(45) Date of Patent: Aug. 23, 2011

(54) IMAGE FORMING APPARATUS

(75) Inventor: Takatoku Shimizu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 263 days.

(21) Appl. No.: 12/232,580

(22) Filed: Sep. 19, 2008

(65) Prior Publication Data

US 2009/0080921 A1 Mar. 26, 2009

(30) Foreign Application Priority Data

Sep. 26, 2007 (JP) ..... 2007-248300
Aug. 21, 2008 (JP) ..... 2008-212657

(51) Int. Cl.
*G03G 15/06* (2006.01)
*G03G 15/08* (2006.01)

(52) U.S. Cl. ..... 399/55; 399/284; 399/285

(58) Field of Classification Search ..... 399/55, 399/274, 270, 284, 285
See application file for complete search history.

(56) References Cited

U.S. PATENT DOCUMENTS

| | | | | |
|---|---|---|---|---|
| 5,164,773 | A | 11/1992 | Nishio et al. | |
| 5,594,198 | A * | 1/1997 | Ikeda et al. | 399/285 |
| 5,761,590 | A * | 6/1998 | Sato | 399/285 |
| 5,870,658 | A * | 2/1999 | Goto et al. | 399/284 |
| 6,026,266 | A | 2/2000 | Sakai et al. | |
| 6,278,849 | B1 * | 8/2001 | Kawasaki | 399/55 |
| 6,353,720 | B1 | 3/2002 | Sakai et al. | |
| 6,671,485 | B2 * | 12/2003 | Hirano | 399/284 |
| 6,751,423 | B2 * | 6/2004 | Sakaizawa et al. | 399/55 |
| 7,221,881 | B2 * | 5/2007 | Do | 399/284 |
| 7,346,301 | B2 * | 3/2008 | Hashimoto et al. | 399/284 |
| 2003/0128997 | A1 | 7/2003 | Sakaizawa et al. | |
| 2007/0053707 | A1 | 3/2007 | Ream et al. | |

FOREIGN PATENT DOCUMENTS

| | | | | |
|---|---|---|---|---|
| JP | 3-054582 | A | | 3/1991 |
| JP | 03-296079 | A | | 12/1991 |
| JP | 5-011599 | A | | 1/1993 |
| JP | 2000003088 | A | | 1/2000 |
| JP | 2000-330364 | A | | 11/2000 |
| JP | 2001-075450 | A | | 3/2001 |
| JP | 2001-343795 | A | | 12/2001 |
| JP | 2002-091095 | A | | 3/2002 |
| JP | 2004-045481 | | | 2/2004 |
| JP | 2004-117733 | A | | 4/2004 |
| JP | 2004-170651 | A | | 6/2004 |
| JP | 2005134651 | A | * | 5/2005 |
| JP | 2005-189767 | A | | 7/2005 |
| JP | 2005326538 | A | * | 11/2005 |
| JP | 2006-030878 | A | | 2/2006 |
| JP | 2006-349955 | A | | 12/2006 |
| JP | 2007-148031 | A | | 6/2007 |
| JP | 2007-232830 | A | | 9/2007 |

* cited by examiner

*Primary Examiner* — Susan S Lee
(74) *Attorney, Agent, or Firm* — Rabin & Berdo, P.C.

(57) ABSTRACT

An image forming apparatus includes a latent image bearing body that bears a latent image, a charging member applied with a charging voltage and configured to charge a surface of the latent image bearing body, a developer bearing body applied with a developing voltage and configured to develop the latent image with a developer, a developer regulating member applied with a regulating-member-application voltage and configured to form a layer of the developer on the developer bearing body, and a voltage switching unit configured to switch the regulating-member-application voltage. In a non-image-forming period, the voltage switching unit switches the regulating-member-application voltage from a voltage set for an image forming period to a different voltage.

18 Claims, 16 Drawing Sheets t1
L0
t2
L1
t3
ID MOTOR
on
off
LED HEAD
on
off
CHARGING VOLTAGE
Vch-1
Vch-0
off
PHOTOSENSITIVE DRUM VOLTAGE
Vdr-1
Vdr-0
Vdr-e
off
DEVELOPING VOLTAGE
Vdv-1
Vdv-0
off
REGULATING BLADE VOLTAGE
Vbl-0
Vbl-1
off ID MOTOR
on
off LED HEAD
on
off CHAGING VOLTAGE
Vch-1
Vch-0
off PHOTOSENSITIVE DRUM VOLTAGE
Vdr-1
Vdr-0
Vdr-e
off DEVELOPING VOLTAGE
Vdv-1
Vdv-0
off REGULATING BLADE VOLTAGE
Vbl-0
Vbl-1
off
t1
t2
t3
t2'
t3'
L0
L1
L1'

FIG.10

(IN PRINTING PERIOD, CHARGING VOLTAGE : −1000 V, DEVELOPING VOLTAGE : −200 V, AND REGULATING BLADE VOLTAGE : −300 V)

| TEST NO. | VOLTAGES FOR FOG-TONER DISCARDING PERIOD | | | FOG LEVEL | | | | |
|---|---|---|---|---|---|---|---|---|
| | CHARGING VOLTAGE | DEVELOPING VOLTAGE | REGULATING BLADE VOLTAGE | (BAD) 1 | 2 | 3 | 4 | (GOOD) 5 |
| 1 | −1200 V | −200 V | −300 V | ○ | | | | |
| 2 | −1000 V | −200 V | −100 V | | | ○ | | |
| 3 | −1000 V | −300 V | −100 V | | | | ○ | |
| 4 | −1200 V | −200 V | −100 V | | | | ○ | |
| 5 | −1200 V | −300 V | −100 V | | | | | ○ |
| 6 | −1000 V | −200 V | −300 V | ○ | | | | |

t4
t5
t6
L0
L2
ID MOTOR
on
off
LED HEAD
on
off
CHARGING VOLTAGE
Vch-0
Vch-2
off
PHOTOSENSITIVE DRUM VOLTAGE
Vdr-0
Vdr-2
Vdr-e
off
DEVELOPING VOLTAGE
Vdv-2
Vdv-0
off
REGULATING BLADE VOLTAGE
Vbl-2
Vbl-0
off t4
t5
t6
t5′
t6′
L0
L2
L2′
ID MOTOR
on
off
LED HEAD
on
off
CHARGING VOLTAGE
Vch-0
Vch-2
off
PHOTOSENSITIVE DRUM VOLTAGE
Vdr-0
Vdr-2
Vdr-e
off
DEVELOPING VOLTAGE
Vdv-2
Vdv-0
off
REGULATING BLADE VOLTAGE
Vbl-2
Vbl-0
off

FIG.17

(IN PRINTING PERIOD, CHARGING VOLTAGE : −1000 V, DEVELOPING VOLTAGE : −200 V, AND REGULATING BLADE VOLTAGE : −300 V)

| TEST NO. | VOLTAGES FOR SMEAR-TONER DISCARDING PERIOD | | | SMEAR LEVEL | | | | |
|---|---|---|---|---|---|---|---|---|
| | CHARGING VOLTAGE | DEVELOPING VOLTAGE | REGULATING BLADE VOLTAGE | (BAD) 1 | 2 | 3 | 4 | (GOOD) 5 |
| 1 | −900 V | −300 V | −300 V | ○ | | | | |
| 2 | −1000 V | −200 V | −500 V | | | ○ | | |
| 3 | −1000 V | −300 V | −500 V | | | | ○ | |
| 4 | −900 V | −200 V | −500 V | | | | ○ | |
| 5 | −900 V | −300 V | −500 V | | | | | ○ |
| 6 | −1000 V | −200 V | −300 V | ○ | | | | |

t7
t8
t9
t10
L0
L1
L2
on
off
ID MOTOR on
off
LED HEAD

Vch-1
Vch-0
Vch-2
off
CHARGING VOLTAGE

Vdr-1
Vdr-0
Vdr-2
Vdr-e
off
PHOTOSENSITIVE DRUM VOLTAGE

Vdv-1/Vdv-2
Vdv-0
off
DEVELOPING VOLTAGE

Vbl-2
Vbl-0
Vbl-1
off
REGULATING BLADE VOLTAGE

IMAGE FORMING APPARATUS

BACKGROUND OF THE INVENTION

The present invention relates to an image forming apparatus.

A conventional image forming apparatus such as a printer, a copier, a facsimile machine, a complex machine or the like is configured to form an image as follows. A charging device uniformly charges a surface of a photosensitive drum. An exposing device irradiates the surface of the photosensitive drum so as to form a latent image. Then, a developing device develops the latent image on the photosensitive drum with a toner to thereby form a toner image. The toner image is transferred to a recording medium, and is fixed to the recording medium by a fixing device.

In the developing device, a toner cartridge supplies a toner (i.e., a developer) to a developing roller and a supplying roller. The toner is electrically charged by frictional electrification at a portion between the developer roller and the supplying roller, and a portion between the developing roller and a developing blade. A toner layer having a uniform thickness is formed on a surface of the developing roller by the developing blade. Generally, an image forming apparatus of non-magnetic and single-component developing type (using a non-magnetic and single-component toner) has a configuration in which the developing roller and the photosensitive drum are disposed in contact with each other. Such an image forming apparatus has a simple and compact structure, and is broadly used.

The image forming apparatus of this type is configured to apply a predetermined charge to the toner so that the toner moves from the developing roller to the latent image on the photosensitive drum. In this regard, if an abnormally charged toner (i.e., a toner with remarkably increased or decreased electric charge) is generated, such an abnormally charged toner is likely to adhere to a non-exposed area on the photosensitive drum, and may cause an abnormal image such as fog or smear.

Therefore, there is proposed a technique for discarding the abnormally charged toner. In the technique disclosed in Japanese Laid-open Patent Publication No. 2004-45481, a predetermined latent image is formed on the surface of the photosensitive drum using the exposing device. The abnormally charged toner in the toner layer on the developing roller adheres to the latent image, and is scraped off therefrom by a cleaning device (i.e., is discarded).

In the above described conventional technique, the abnormally charged toner in the toner layer on the developing roller can be discarded. However, other abnormally charged toner existing in the interior of the developing device can not be discarded.

SUMMARY OF THE INVENTION

The present invention is intended to provide an image forming apparatus capable of effectively discarding abnormally charged toner from the developing device.

The present invention provides an image forming apparatus including a latent image bearing body that bears a latent image, a charging member applied with a charging voltage and configured to charge a surface of the latent image bearing body, a developer bearing body applied with a developing voltage and configured to develop the latent image by causing a developer to adhere to the latent image, a developer regulating member applied with a regulating-member-application voltage and configured to form a layer of the developer on the developer bearing body, and a voltage switching unit configured to switch the regulating-member-application voltage. In a non-image-forming period, the voltage switching unit switches the regulating-member-application voltage from a voltage set for an image forming period to a different voltage.

The present invention also provides an image forming apparatus including a latent image bearing body that bears a latent image, a charging member applied with a charging voltage and configured to charge a surface of the latent image bearing body, a developer bearing body applied with a developing voltage and configured to develop the latent image by causing a developer to adhere to the latent image, and a developer regulating member applied with a regulating-member-application voltage and configured to form a layer of the developer on the developer bearing body. In a non-image-forming period, an absolute value of the regulating-member-application voltage is smaller than or equal to an absolute value of the developing voltage.

The present invention also provides an image forming apparatus including a latent image bearing body that bears a latent image, a charging member applied with a charging voltage and configured to charge a surface of the latent image bearing body, a developer bearing body applied with a developing voltage and configured to develop the latent image by causing a developer to adhere to the latent image, and a developer regulating member applied with a regulating-member-application voltage and configured to form a layer of the developer on the developer bearing body. In a non-image-forming period, an absolute value of the regulating-member-application voltage is larger than an absolute value of the developing voltage, and a difference between the regulating-member-application voltage and the developing voltage is larger than in an image forming period.

With such an arrangement, the abnormally charged toner can be discarded from the developing device, and fog and/or smear can be prevented.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 10 is a table showing an experimental result of the first embodiment of the present invention;

FIG. 17 is a table showing an experimental result of the second embodiment of the present invention;

DETAILED DESCRIPTION OF THE PREFERRED EMBODIMENT

Hereinafter, embodiments of the present invention will be described with reference to the attached drawings.

First Embodiment

Figure 1:
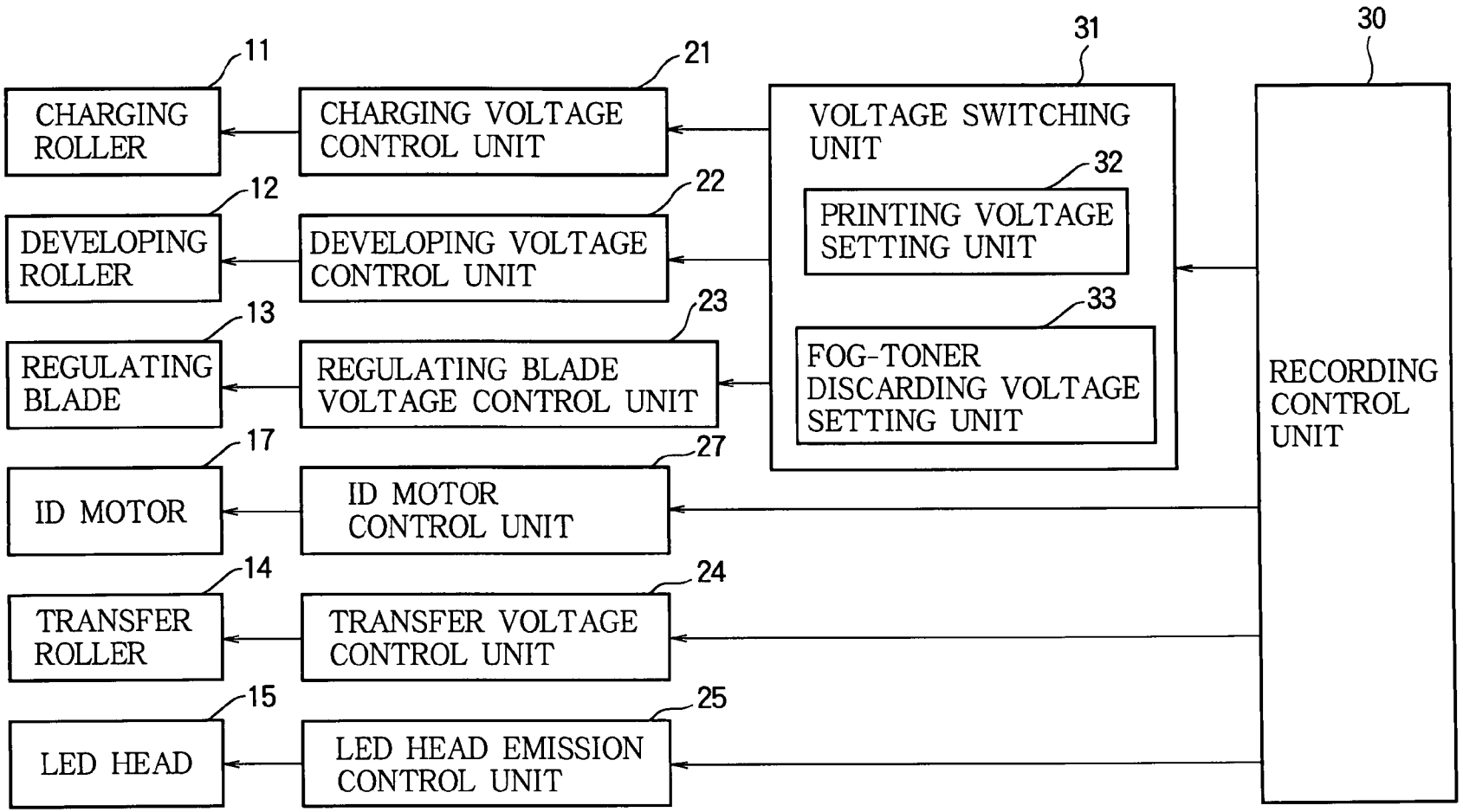
FIG. 1 is a block diagram showing a control system of an image forming apparatus according to the first embodiment of the present invention.
Figure 2:
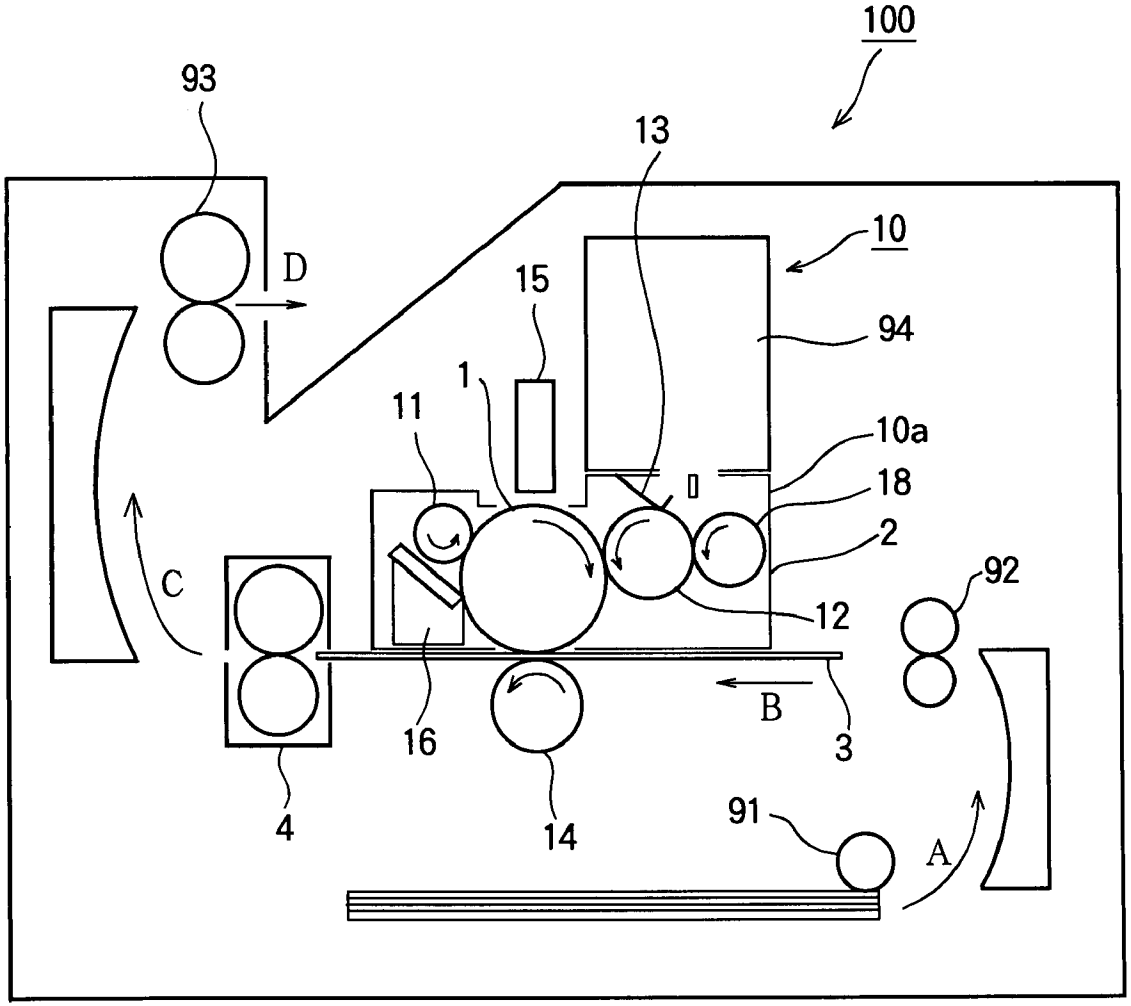
FIG. 2 is a sectional view showing the image forming apparatus according the first embodiment of the present invention.
Figure 3:
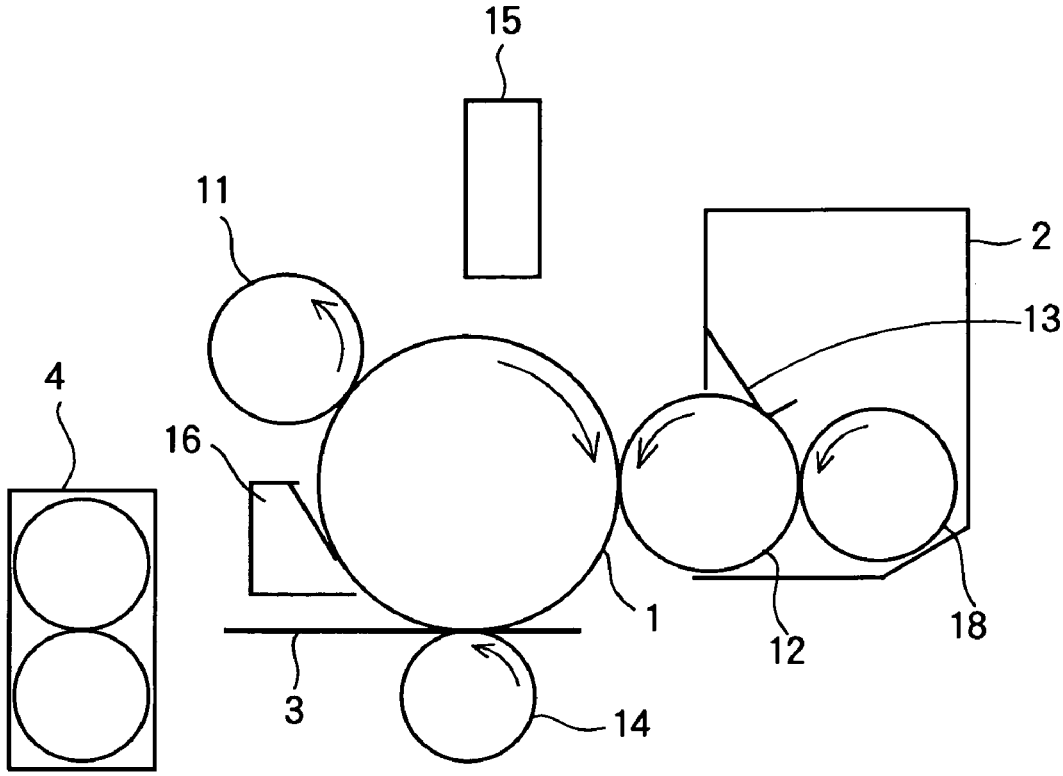
FIG. 3 is a schematic view showing a main part of the image forming apparatus according to the first embodiment of the present invention.

FIG. 1 is a block diagram showing a control system of an image forming apparatus according to the first embodiment of the present invention. FIG. 2 is a sectional view showing the image forming apparatus according the first embodiment of the present invention. FIG. 3 is a schematic view showing a main part of the image forming apparatus according to the first embodiment of the present invention.

An image forming apparatus 100 according to this embodiment can be any kind of image forming apparatus such as a printer, a facsimile machine, a copier, a combined machine (having a plurality of functions) or the like. Here, the image forming apparatus 100 takes the form of an electrophotographic printer that forms an image using electrophotography. Although the image forming apparatus 100 can be configured to form a color image, the image forming apparatus 100 will be described as an image forming apparatus that forms a monochrome image for convenience of explanation.

As shown in FIG. 2, the image forming apparatus 100 includes an image forming unit 10 and a fixing unit 4 which are arranged along a feeding path of a recording medium (such as a paper) 3. A stack of the recording media 3 is stored in a cassette or the like. The recording medium 3 is individually picked up by a pickup roller 91, and is fed in a direction shown by an arrow A to reach a pair of registration rollers 92. The registration rollers 92 start rotating at a predetermined timing, and feed the recording medium 3 along a feeding path in the direction shown by an arrow B. As the recording medium 3 is fed along the feeding path, a toner image (i.e., a developer image) formed by the image forming unit 10 is transferred to the recording medium 3.

The recording medium 3 (to which the toner image is transferred) is fed to a fixing unit 4 where a fixing process is performed. The fixing unit 4 applies heat and pressure to the toner image, so that the toner image is fixed to the recording medium 3. The recording medium 3 (to which the toner image is fixed) is further fed along an ejection path in the direction shown by an arrow C. The recording medium 3 is ejected out of the image forming apparatus 100 by a pair of ejection rollers 93 in the direction shown by an arrow D, and is stacked on a stacker outside the image forming apparatus 100.

The image forming unit 10 includes a photosensitive drum 1 as a latent image bearing body, a charging roller 11 as a charging device for charging the surface of the photosensitive drum 1, a developing unit 2 as a developing device for developing the latent image on the photosensitive drum 1, a cleaning device 16 or the like. The photosensitive drum 1, the charging roller 11, the developing unit 2 and the cleaning device 16 are housed in a housing 10*a*.

The developing unit 2 stores a toner (i.e., a developer) supplied by a toner cartridge 94 as a developer storing body. The developing unit 2 includes a developing roller 12 (i.e., a developer bearing body) disposed facing the photosensitive drum 1, and a toner supplying roller 18 (i.e., a supplying member) for supplying the toner to the developing roller 12, a regulating blade 13 (i.e., a developer regulating member) for forming a thin toner layer on the surface of the developing roller 11.

An LED (Light Emitting Diode) head 15 as a light emitting element (or a latent image writing device) is disposed facing the photosensitive drum 1. The LED head 15 irradiates the surface of the photosensitive drum 1 according to the image data to thereby form a latent image. A transfer roller 14 (i.e., a transferring device) is disposed facing the photosensitive drum 1 via the feeding path of the recording medium 3.

The cleaning device 16 is configured to clean the surface of the photosensitive drum 1 by scraping off the toner therefrom, and stores the scraped-off toner as a waste toner. The stored waste toner is conveyed outside the image forming unit 10 by a waste toner recovery unit (not shown) having a spiral or the like.

The photosensitive drum 1, the developing roller 12, the toner supplying roller 18, the charging roller 11 and the transfer roller 14 are rotated in directions respectively shown by arrows in FIG. 2. The photosensitive drum 1 is driven by an ID motor 17 described later. The rotation of the photosensitive drum 1 is transmitted to the developing roller 12 and the toner supplying roller 18 via not show gears. The charging roller 11 is driven by a friction between the charging roller 11 and the photosensitive drum 1.

The photosensitive drum 1 is composed of, for example, a drum-shaped conductive body of aluminum or the like and a photoconductive layer formed on the conductive body. The charging roller 11 is composed of a conductive shaft of stainless or the like and a conductive resilient layer of epichlorohydrin or the like formed on the shaft. The charging roller 11 contacts the surface of the photosensitive drum 1 to thereby uniformly charge the surface of the photosensitive drum 1.

The LED head 15 is provided for selectively exposing the uniformly charged surface of the photosensitive drum 1 to form a latent image, and is composed of an LED element, an LED driving element and a lens array. The LED head 15 is disposed so that light emitted by the LED head 15 is focused on the surface of the photosensitive drum 1.

The developing roller 12 is composed of, for example, a conductive shaft of stainless steel or the like and a conductive resilient layer of urethane or the like formed around the shaft. The toner supplying roller 18 is composed of, for example, a conductive shaft of stainless steel or the like and a foaming resilient layer of silicone or the like formed around the shaft. The toner supplying roller 18 is disposed in contact with the developing roller 12. The regulating blade 13 is composed of, for example, a plate member of stainless steel. The regulating blade 13 is disposed so that a tip thereof is pressed against the surface of the developing roller 12. The developing unit 2 is disposed so that the developing roller 12 contacts the surface of the photosensitive drum 1.

The transfer roller 14 is composed of, for example, a foaming resilient body having conductivity. The transfer roller 14 is disposed in contact with the photosensitive drum 1 so as to transfer the toner image on the photosensitive drum 1 to the recording medium 3.

The cleaning device 16 is provided for scraping off a residual toner remaining on the surface of the photosensitive drum 1 after the transferring and a fog-toner (having been moved from the developing unit 2 to the photosensitive drum 1 as described later) to discard the scraped-off toner as a waste toner. The cleaning device 16 includes a rubber blade whose tip is pressed against the surface of the photosensitive drum 1 so as to scrape off the toner therefrom.

Next, the control system of the image forming apparatus 100 will be described.

As show in FIG. 1, the charging roller 11 is applied with a charging voltage by a charging voltage control unit 21. The developing roller 12 is applied with a developing voltage by a developing voltage control unit 22. The regulating blade 13 is applied with a regulating blade voltage (i.e., a regulating-member-application voltage) by a regulating blade voltage control unit 23.

The charging voltage control unit 21, the developing voltage control unit 22 and the regulating blade control unit 23 are connected to a voltage switching unit 31. The voltage switching unit 31 includes a printing voltage setting unit 32 and a fog-toner discarding voltage setting unit 33. According to the instruction from a recording control unit 30, the voltage switching unit 31 switches between voltages for printing period (held in the printing voltage setting unit 32) and voltages for fog-toner discarding period (held in the fog-toner discarding voltage setting unit 33), which are notified to the charging voltage control unit 21, the developing voltage control unit 22 and the regulating blade voltage control unit 23. The charging voltage control unit 21, the developing voltage control unit 22 and the regulating blade voltage control unit 23 output voltages according to voltage settings notified by the voltage switching unit 31.

The ID motor 17 is connected to an ID motor control unit 27. The transfer roller 14 is connected to a transfer voltage control unit 24. The LED head 15 is connected to an LED head emission control unit 25. The ID motor control unit 27, the transfer voltage control unit 24 and the LED head emission control unit 25 respectively control the driving of the ID motor 17, the transfer voltage applied to the transfer roller 14 and the light emission of the LED head 15 according to the instruction from the recording control unit 30.

Next, the operation of the image forming apparatus 100 will be described.

First, a printing operation will be described. In the printing operation, the charging roller 11 is applied with the charging voltage to thereby uniformly charge the surface of the photosensitive drum 1. Then, the LED head 15 is driven to emit light according to image data from the recording control unit 30, to thereby form a latent image on the surface of the photosensitive drum 1. Further, the developing roller 12 with the toner layer formed on the surface thereof is applied with the developing voltage, to thereby develop the latent image on the surface of the photosensitive drum 1. In this regard, the regulating blade 13 is applied with the regulating blade voltage for controlling electric charge of the toner in the toner layer on the developing roller 12 to a predetermined value.

Next, the transfer roller 14 is applied with the transfer voltage to thereby transfer the toner image on the surface of the photosensitive drum 1 to the recording medium 3. Then, the toner image is fixed to the recording medium 3 by the fixing unit 4, and the printing operation is completed.

In this regard, in the case where the image forming apparatus 100 is operated at normal temperature and normal humidity (20-25° C., 40-60%) using a negatively-chargeable toner, the charging voltage is set to −1000 V, the developing voltage is set to −200 V and the regulating blade voltage is set to −300 V. The surface of the photosensitive drum 1 is charged when the charging roller 11 is applied with a predetermined voltage or more, and the surface voltage of the photosensitive drum 1 increases in corporation with the applied voltage. In this embodiment, the surface voltage of the photosensitive drum 1 is −500 V. The latent image formed by the irradiation by the LED head 15 has a voltage (potential) of −100 V, and the latent image is developed with toner by the developing roller 12 (in reverse development). The negatively-chargeable toner is composed of a polystyrene resin to which silica or the like is externally added for providing chargeability and fluidity.

The term "image density" indicates a density of the toner image formed according to image data. To be more specific, the image density is a rate of an area of toner image to a printable area. If the toner image is formed on the entire printable area (i.e., so-called solid printing), the image density is 100%.

In the toner layer formed on the developing roller 12, only the toner corresponding to the latent image is used for development. Other toner remains on the developing roller 12 by a large amount in the case where a printing of low image density is performed. Such toner remaining on the developing roller 12 returns to the developing unit 2, and is scraped off from the developing roller 12 by the toner supplying roller 18. Further, such toner is subjected to a frictional electrification between the developing roller 12 and the toner supplying roller 18, and a frictional electrification between the developing roller 12 and the regulating blade 13. A part of such toner is carried to a nip portion between the photosensitive drum 1 and the developing roller 12, and another part of such toner does not pass the regulating blade 13 and remains in the interior of the developing unit 2.

Therefore, if the printing of low image density is repeatedly performed, the toner remaining on the surface of the developing roller 2 and remaining in the interior of the developing unit 2 may suffer damage. In such a case, the external additives such as silica may be separated from the toner or may be buried into the toner, which may cause reduction of chargeability or may cause charging with reverse polarity. Further, the toner remaining on the developing roller 12 (i.e., not being scraped off therefrom by the toner supplying roller 18) may be repeatedly subjected to frictional electrification, and therefore electric charge of the toner may increase.

Next, a distribution of electric charge of the toner in the toner layer on the developing roller 12 will be described.

Figure 4:
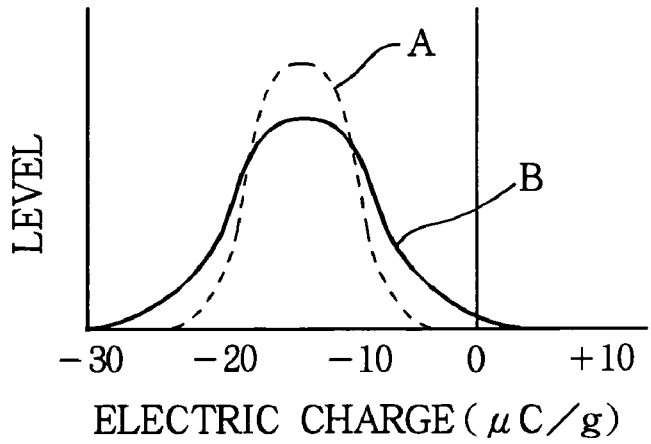
FIG. 4 is a graph showing a distribution of electric charge of a toner in a toner layer on a developing roller according to the first embodiment of the present invention.

FIG. 4 is a graph showing a distribution of electric charge of the toner in the toner layer formed on the developing roller according to the first embodiment of the present invention.

In FIG. 4, a dashed line A shows a distribution of electric charge of the toner in the toner layer on the surface of the developing roller 12 at an initial state. A solid line B shows a distribution of electric charge of the toner in the toner layer on the developing roller 12 after the low density printing is performed on 20000 pages.

In FIG. 4, it is understood that, after the low density printing is performed, a distribution width of electric charge is widened compared with the initial stage, i.e., the existing probability of a low-charge toner and a high-charge toner increases. Further, it is understood from FIG. 4 that reversely-charged toner (here, positively charged toner) is generated after the low density printing.

The reversely-charged toner tends to be electro-statically attracted to non-exposed areas of the surface of the photosensitive drum 1*a*, and the low-charge toner tends to move toward the photosensitive drum 1 in the printing process because a force (i.e., image force) with which the toner adheres to the developing roller 12 is weak. Such toner is likely to adhere to a background area of the image, i.e., fog is likely to occur. The phenomenon where the low-charge toner and the reversely-charged toner adhere to the background area of the image is referred to as a "fog". Further, the low-charge toner and the reversely-charged toner that cause the fog are referred to as a "fog-toner" (i.e., a fog-causing developer).

In this embodiment, the charging voltage, the developing voltage and the regulating blade voltage are switched from voltages for the printing period to voltages for the fog-toner discarding period, to thereby selectively discard the low-charge toner and the reversely-charged toner (i.e., the fog-toner) during a non-image-forming period. In other words, the charging voltage, the developing voltage and the regulating blade voltage are switched from voltages for the image forming period to predetermined voltages for the non-image-forming period so as to efficiently discard the fog-toner from the developing unit 2.

In this regard, the term "image forming operation" means an operation for forming a toner image using a normally-charged toner on the photosensitive drum 1, and includes a printing operation for forming a toner image (to be transferred to the recording medium 3) according to image data, and a forming operation of a compensation pattern such as a color shift compensation pattern and an image density compensation pattern. The charging voltage, the developing voltage, the regulating blade voltage and the supplying voltage for these operations are voltages for image forming period (to be more specific, voltages for printing period).

Further, the term "non-image-forming operation" means operations other than the above described image forming operation. A "fog-toner discarding period" is provided as a certain period in a non-image-forming period (i.e., a period for non-image-forming operation). The fog-toner discarding period is a voltage-varying period in which the voltages are switched from voltages set for the image-forming period. In other words, the voltage-varying period is a part of the non-image-forming period. In this regard, the voltage-varying period can be provided in any period in the non-image-forming period while the image forming apparatus 100 is driven.

Next, a relationship between the photosensitive drum voltage, the developing voltage and the regulating blade voltage for the fog-toner discarding period will be described.

Figure 5:
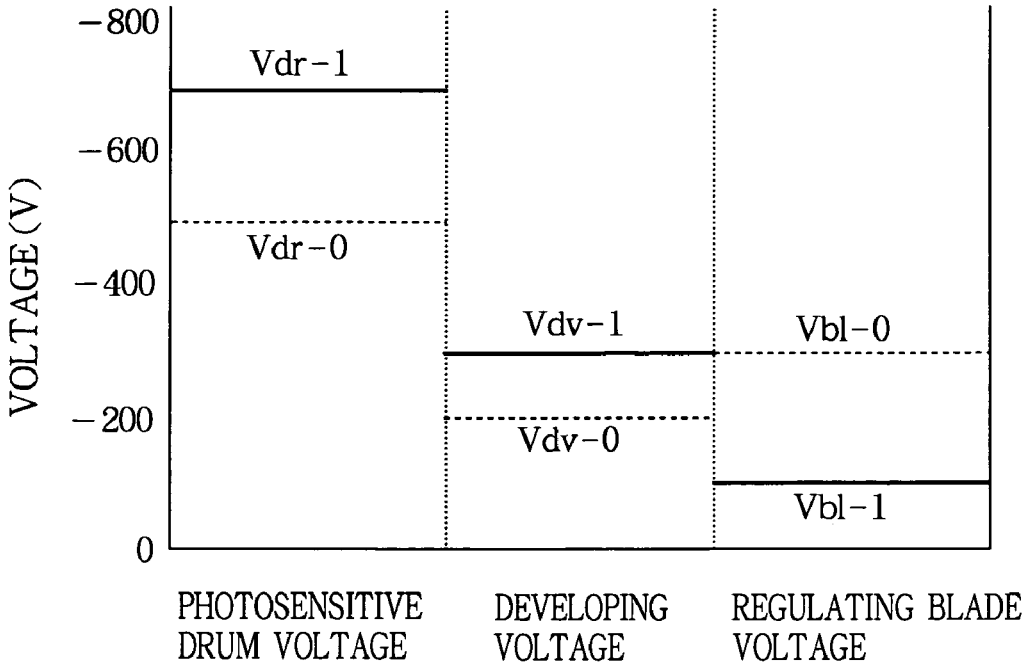
FIG. 5 is a graph showing a relationship between a photosensitive drum voltage, a developing voltage and a regulating blade voltage in a fog-toner discarding period according to the first embodiment of the present invention.

FIG. 5 is a graph showing the relationship between the photosensitive drum voltage, the developing voltage and the regulating blade voltage for the toner discarding period according to the first embodiment of the present invention.

In FIG. 5, examples of the photosensitive drum voltage, the developing voltage and the regulating blade voltage for the fog-toner discarding period are shown by solid lines, compared with the respective voltages (shown by dashed lines) for the printing period.

In the printing period (i.e., an ordinary printing process), the regulating blade voltage Vbl-0 is set to be larger than (and of the same polarity as) the developing voltage Vdv-0, to thereby generate an electric field in which the polarity of the regulating blade 13 side with respect to the developing roller 12 is the same as the toner. Such an electric field causes the normally charged toner to pass the regulating blade 13. Here, the regulating blade voltage Vbl-0 is set to −300 V and the developing voltage Vdv-0 is set to −200 V, so that the voltage difference between the regulating blade voltage Vbl-0 and the developing voltage Vdv-0 is −100 V (=(−300 V)−(−200 V)).

The charging voltage is set so as to cause the toner on the developing roller 12 to adhere to the latent image (i.e., reverse development) and to prevent the toner from adhering to other area than the latent image in the printing period. Here, the charging voltage of −1000 V is applied to the charging roller 11 so that the photosensitive drum voltage Vdr-0 (i.e., a surface voltage of the photosensitive drum 1) is −500 V. After the LED head 15 irradiates the surface of the photosensitive drum 1, the electric potential of the latent image (i.e., a latent image potential) Vdr-e is −100 V.

With such an arrangement, the voltage difference between the photosensitive drum voltage Vdr-0 and the developing voltage Vdv-0 is −300 V (=(−500 V)−(−200 V)) with which the normally charged toner is prevented from moving toward other area than the latent image. Further, the difference between the regulating blade voltage Vbl-0 and the developing voltage Vdv-0 is −100 V (=(−300 V)−(−200 V)) with which the latent pattern is developed with the normally charged toner.

In contrast, during the fog-toner discarding period in the non-image-forming period, the absolute value of the regulating blade voltage is changed to be smaller than that of the printing period. As the absolute value of the regulating blade voltage decreases, the difference between the regulating blade voltage and the developing voltage also decreases. Accordingly, a force with which the reversely-charged toner is attracted to the regulating blade 13 is weakened, and therefore the fog-toner is more likely to pass the regulating blade 13. The regulating blade voltage is preferably of the same polarity as the developing voltage, and the absolute value of the regulating blade voltage is preferably smaller than the absolute value of the developing voltage.

With this, an electric field is formed, in which the polarity of the regulating blade 13 side with respect to the developing blade 12 is opposite to the normally charged toner. Therefore, the normally charged toner is attracted to the regulating blade 13. Thus, the probability that the fog-toner in the developing unit 2 passes the regulating blade 13 further increases. Here, during the fog-toner discarding period, the regulating blade voltage Vbl-1 is set to −100 V, the developing voltage Vdv-1 is set to −300 V so that the voltage difference between the regulating blade voltage Vbl-1 and the developing voltage Vdv-1 is +200 V (=(−100 V)−(−300 V)).

Next, the distribution of the electric charge of the toner in the toner layer on the surface of the developing roller 12 in the fog-toner discarding period will be described.

Figure 6:
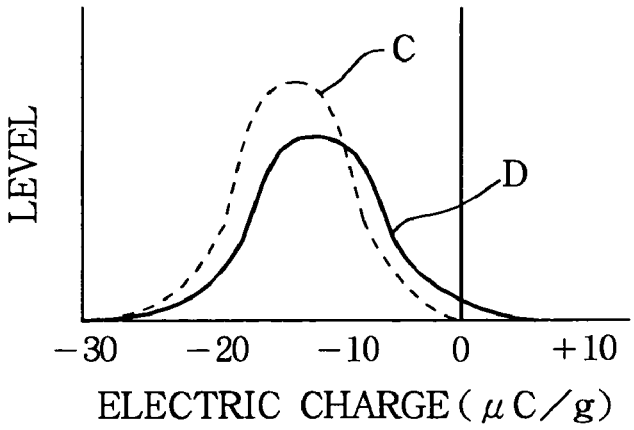
FIG. 6 is a graph showing a distribution of electric charge of the toner in the toner layer on the developing roller in the fog-toner discarding period according to the first embodiment of the present invention.
Figures 7A, 7B, 7C, 7D, 7E, 7F:
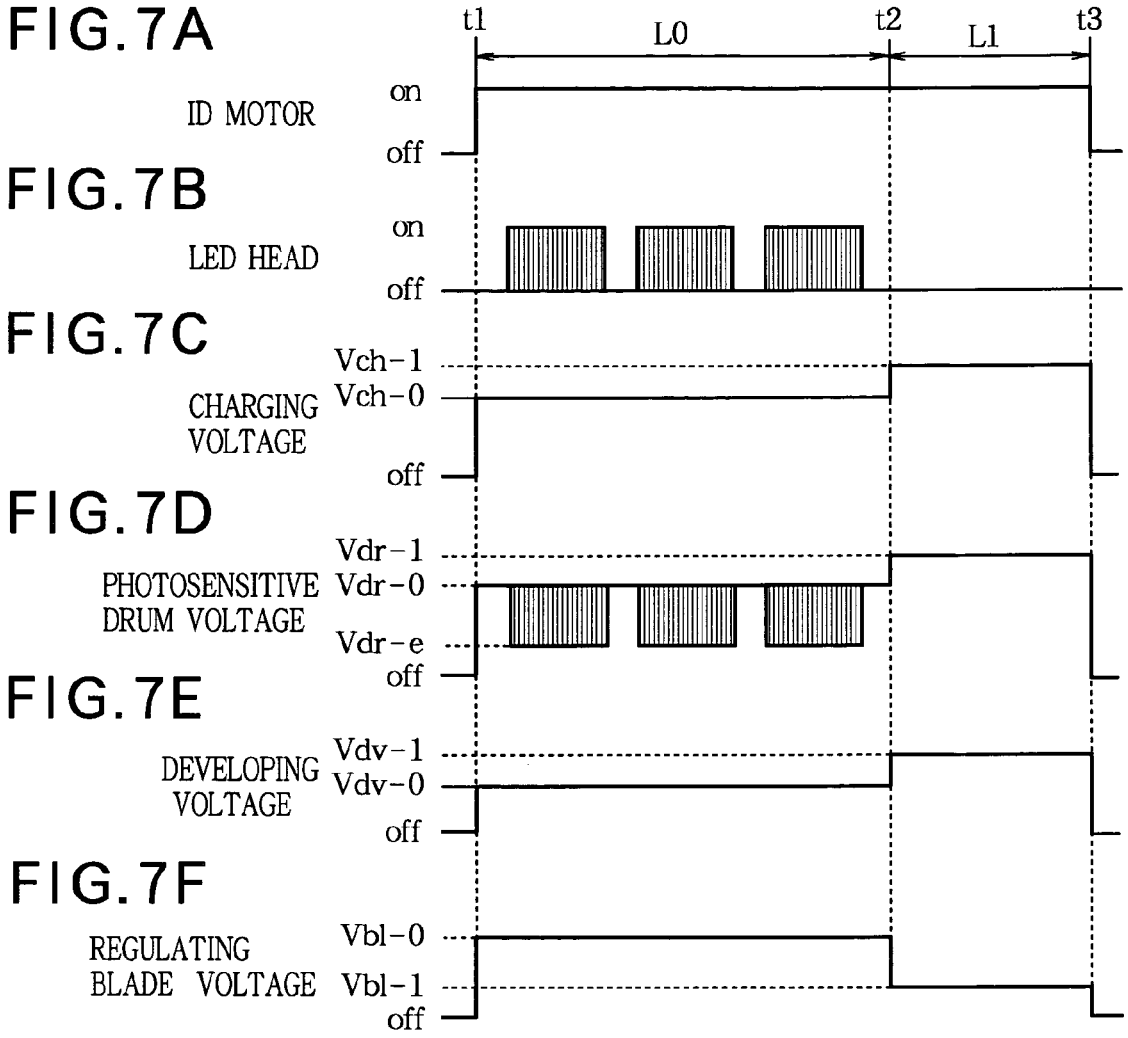
FIGS. 7A through 7F show a timing chart illustrating operation timings of respective parts according to the first embodiment of the present invention.
Figures 8A, 8B, 8C, 8D, 8E, 8F:
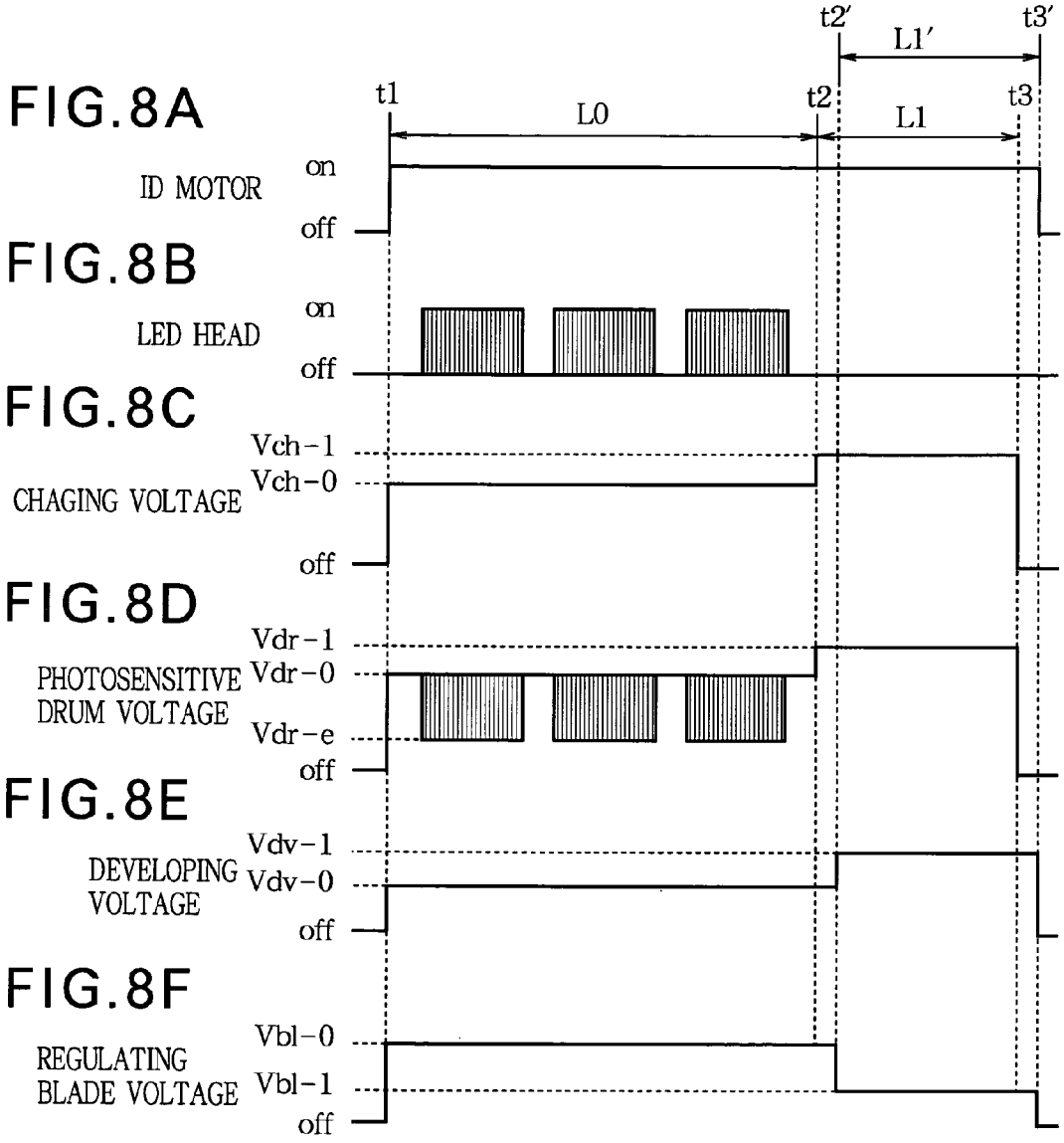
FIGS. 8A through 8F show a timing chart illustrating operation timings of respective parts according to another example of the first embodiment of the present invention.

FIG. 6 is a graph showing the distribution of electric charge of the toner in the toner layer formed on the developing roller.

FIG. 6 shows the distribution of electric charge of the toner in the toner layer on the developing roller 12 in the fog-toner discarding, compared with that in the printing period. The distribution of electric charge of the toner in the fog-toner discarding period shown by a solid line D is shifted to lower side (i.e., right side in FIG. 6), compared with that in the printing period shown by a dashed line C. Therefore, it is understood that existing probability of the low-charge toner increases in the fog-toner discarding period. It is thus understood that the probability that fog-toner in the developing unit 2 passes the developing blade 13 and moves to the surface of the developing roller 12 increases.

Further, the voltage difference between the photosensitive drum voltage Vdr-1 and the developing voltage Vdv-1 is set to be larger than the voltage difference in the printing period. With this, the fog-toner on the surface of the developing roller 12 is more likely to adhere to the surface of the photosensitive drum 1.

In this embodiment, the photosensitive drum voltage Vdr-1 is −700 V and the developing voltage Vdv-1 is −300 V so that the voltage difference between the photosensitive drum voltage Vdr-1 and the developing voltage Vdv-1 is −400 V (=(−700 V)−(−300 V)). In order to set the photosensitive drum voltage Vdr-1 to −700 V, the charging voltage Vch-1 of −1200 V is applied to the charging roller 11.

Next, operation timings of respective parts in the fog-toner discarding period will be described.

FIGS. 7A through 7F show a timing chart illustrating operation timings of the ID motor 17, the light emission of the LED head 15, the charging voltage, the photosensitive drum voltage, the developing voltage and the regulating blade voltage according to the first embodiment of the present invention.

First, a print job is started in response to a print job starting signal from the recording control unit 30, and the ID motor 17 is turned on (t1). This causes the photosensitive drum 1, the charging roller 11, the developing roller 12 and the toner supplying roller 18 to start rotating. A charging voltage Vch-0 for the printing period is applied to the charging roller 11 in synchronization with the starting of the rotation. By the application of the charging voltage Vch-0, the surface of the photosensitive drum 1 is charged to the photosensitive drum voltage Vdr-0 for the printing period. At the same time (at the timing t1), the developing voltage Vdv-0 for the printing period is applied to the developing roller 12, and the regulating blade voltage Vbl-0 for the printing period is applied to the regulating blade 13. With this, a printing period L0 is started.

Subsequently, the LED head 15 starts the light emitting operation according to page synchronization signal and image data. When the LED head 15 emits light, the electric potential of the irradiated area of the photosensitive drum 1 is lowered to the latent image potential Vdr-e, and a latent image is formed. The latent image is developed by the toner, with the result that the toner image is formed according to the image data. When the LED head 15 completes the light emitting operation for pages corresponding to the image data, the printing period L0 ends (t2).

At the timing t2, the recording medium 3 (on which the image is formed) is ejected, and the voltages are switched. To be more specific, at the timing t2, the charging voltage is switched to the charging voltage Vch-1 for the fog-toner discarding period while the ID motor 17 is kept turned on. By the switching of the charging voltage, the photosensitive drum voltage is switched to the photosensitive drum voltage Vdr-1 for the fog-toner discarding period. Further, at the timing t2, the developing voltage is switched to the developing voltage Vdv-1 for the fog-toner discarding period, and the regulating blade voltage is switched to the regulating blade voltage Vbl-1 for the fog-toner discarding period. With this, the fog-toner discarding period L1 is started.

Here, description has been made to an example where the developing voltage and the regulating blade voltage are switched at the same time as the charging voltage. However, a time delay can be provided therebetween corresponding to a time for the photosensitive drum 1 to rotate a distance between the charging roller 11 and the developing roller 12 along the circumference of the photosensitive drum 1.

The fog-toner discarding period (L1) continues to a timing t3. At the timing t3, the ID motor 17, the charging voltage, the developing voltage, the photosensitive drum voltage and the regulating blade voltage are turned off. With this, the print job is completed, and an off-state continues until next print job is received. In this regard, during the above described fog-toner discarding period (L1), the light emission of the LED head 15 is turned off, and no latent image is formed on the photosensitive drum 1.

As the fog-toner discarding period (L1) is longer, the amount of discarded fog-toner increases. However, as the fog-toner discarding period (L1) is longer, the revolution of the photosensitive drum 1 increases, and therefore the lifetime of the photosensitive drum 1 is shortened and the printing throughput becomes low. Therefore, it is necessary to suitably adjust the length of the fog-toner discarding period (L1) according to application of the image forming apparatus. To be more specific, it is necessary to discard at least the fog-toner existing around the developing roller 12, and more preferably to discard the fog-toner existing around the toner supplying roller 18 as well as the fog-toner existing around the developing roller 12. Therefore, the fog-toner discarding period (L1) is preferably longer than or equal to a time required for the developing roller 12 to rotate by one rotation, and more preferably longer than or equal to a sum of a time required for the developing roller 12 to rotate by one rotation and a time required for the toner supplying roller 18 to rotate by one rotation.

As above, description has been made to the example in which all of the regulating blade voltage, the developing voltage and the charging voltage are switched from the voltages for the printing period to the voltages for the fog-toner discarding period.

In this embodiment, the entire printing period L0 is described as the image forming period. In this regard, the image forming period includes, at least, a process for charging of the photosensitive drum 1, a process for exposing the photosensitive drum 1, a process for developing the latent image with toner using the developing roller 12, and a process for transferring the toner image to the recording medium 3 or a transferring body such as a transfer belt.

In this embodiment, the voltage-changing period is provided in the non-image-forming period between the print job and the subsequent print job. Further, in this embodiment, a time interval between pages, for example, a time interval between the first page and the second page or between the second page and the third page is regarded as a part of the image forming period. However, such a time interval can be regarded as a part of the non-image-forming period. In such a case, the voltage-changing period can be provided in the time interval between pages.

In the example shown in FIGS. 7A through 7F, the charging voltage, the developing voltage and the regulating blade voltage are switched at the same time. However, it is also possible to switch the respective voltages at different times in consideration of the rotational position of the photosensitive drum 1.

Next, another example of the operation timings of the respective parts in the fog-toner discarding period will be described.

FIGS. 8A through 8F show a timing chart illustrating operation timings of the ID motor 17, the light emission of the LED head 15, the charging voltage, the photosensitive drum voltage, the developing voltage and the regulating blade voltage in the fog-toner discarding period according to another example of the first embodiment of the present invention. FIGS. 9A through 9E are schematic views for illustrating the relationship between the photosensitive drum, the developing roller and the charging roller in the fog-toner discarding period according to the example shown in FIGS. 8A through 8F.

First, a print job is started in response to a print job starting signal from the recording control unit 30, and the ID motor 17 is turned on (t1). This causes the photosensitive drum 1, the charging roller 11, the developing roller 12 and the toner supplying roller 18 to start rotating. The charging voltage Vch-0 for the printing period is applied to the charging roller 11 in synchronization with the starting of the rotation. By the application of the charging voltage Vch-0, the surface of the photosensitive drum 1 is charged to the photosensitive drum voltage Vdr-0 for the printing period. At the same time (at the timing t1), the developing voltage Vdv-0 for the printing period is applied to the developing roller 12, and the regulating blade voltage Vbl-0 for the printing period is applied to the regulating blade 13. With this, a printing period L0 is started.

Subsequently, the LED head 15 starts the light emitting operation according to page synchronization signal and image data. When the LED head 15 emits light, the electric potential of the irradiated area of the photosensitive drum 1 is lowered to a latent image potential Vdr-e and a latent image is formed. The latent image is developed by the toner, with the result that the toner image is formed. When the LED head 15 completes the light emitting operation, the printing period L0 ends (t2).

Figure 9A:
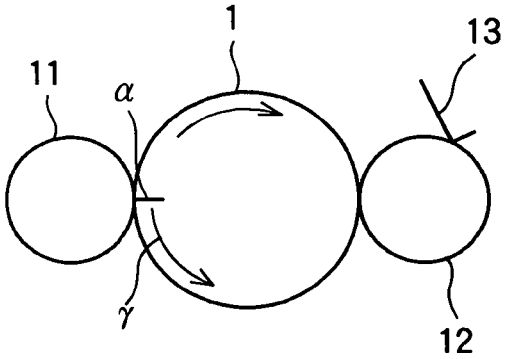
FIGS. 9A through 9E are schematic views showing a relationship between a photosensitive drum, a developing roller and a charging roller in the fog-toner discarding period according to the example shown in FIGS. 8A through 8F.

At the timing t2, the photosensitive drum 1, the charging roller 11 and the developing roller 12 are respectively at positions as shown in FIG. 9A. Here, a position α is defined as a position on the surface of the photosensitive drum 1 that faces the charging roller 11 at the timing t2. At the timing t2, the charging voltage is switched to Vch-1. Thereafter, an area γ on the downstream side of the position α on the surface of the photosensitive drum 1 has a surface potential of Vdr-1.

Figure 9B:
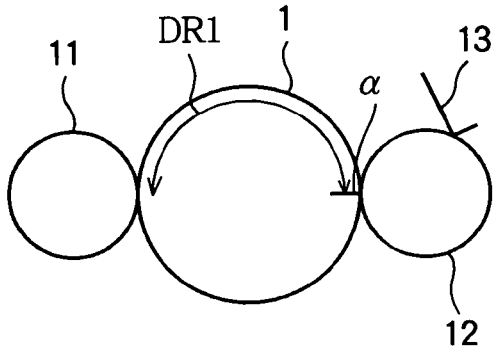

Further, when the photosensitive drum 1 is further rotated (t2'), the photosensitive drum 1, the charging roller 11 and the developing roller 12 are respectively at positions as shown in FIG. 9B. In this state, the position α on the photosensitive drum 1 faces the developing roller 12. At the timing t2', the developing voltage is switched to Vdv-1. Thereafter, when an area DR1 on the downstream side of the position α (on the surface of the photosensitive drum 1) faces the developing roller 12, the fog-toner (on the developing roller 12) adheres to the surface of the photosensitive drum 1. Here, the area DR1 has a length sufficient for moving the fog-toner on the developing roller 12 (more preferably, on the developing roller 12 and the toner supplying roller 18) to the photosensitive drum 1.

Figure 9C:
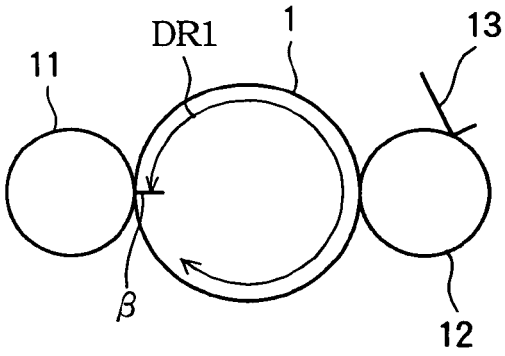

Further, at a timing t3, the photosensitive drum 1, the charging roller 11 and the developing roller 12 are respectively at positions as shown in FIG. 9C. A position β is defined as a downstream end of the area DR1. When the position β faces the charging roller 11, the charging voltage is turned off. In this regard, if the printing is continuously performed (for example, if the image forming apparatus 100 receives next print job), the charging voltage is switched to Vch-0.

Figure 9D:
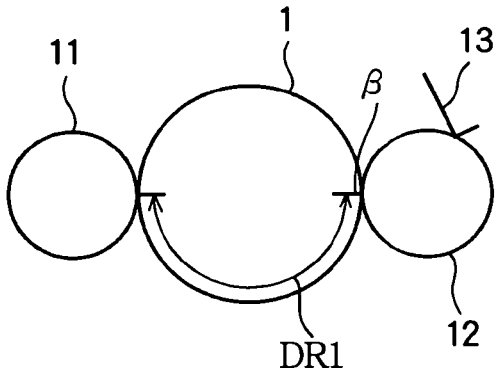

Further, at a timing t3', the photosensitive drum 1, the charging roller 11 and the developing roller 12 are respectively at positions as shown in FIG. 9D. When the position β faces the developing roller 12, the developing voltage is turned off, and the fog-toner discarding period ends.

Figure 9E:
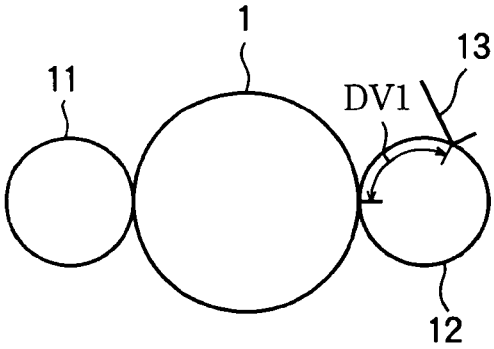

The timing of the switching of the regulating blade voltage is the same as the timing of the switching of the developing voltage. However, as shown in FIG. 9E, the regulating blade voltage can be switched at a different timing from the switching of the developing voltage in accordance with a distance DV1 between a position where the developing roller 12 faces the photosensitive drum 1 and a position where the developing roller 12 faces the regulating blade 13. It is also possible that the ID motor 17 is turned off after the timing t3' (i.e., when the developing voltage and the regulating blade voltage are turned off).

Next, an experiment in which the fog-toner discarding operation is performed while changing respective voltages will be described.

FIG. 10 is a table showing experimental results according to the first embodiment of the present invention.

In this experiment, the fog-toner discarding operation is performed while varying a combination of the regulating blade voltage, the developing voltage and the charging voltage. The printing is performed after the fog-toner discarding operation, and how the fog on the recording medium 3 is improved (compared with fog on the recording medium 3 printed before the fog-toner discarding operation) is visually evaluated. The evaluation results are shown in FIG. 10.

The regulating blade voltage, the developing voltage and the charging voltage are switched as shown in FIG. 5. During the printing period, the charging voltage is −1000 V, the photosensitive drum voltage is −500 V, the developing voltage is −200V and the regulating blade voltage is −300 V.

The measurement of the fog is performed as follows. The image forming apparatus 100 is stopped while the image forming apparatus 100 is performing a printing of image density of 0%. Further, an adhesion tape "Scotch Mending Tape" (manufactured by Sumitomo 3M Ltd.), which is referred to as a fog-sampling tape, is attached to the surface of the photosensitive drum 1 after development of the latent image and before transferring of the developed image. Then, the fog-sampling tape (to which the toner adheres) is attached to a white paper. For comparison, an adhesion tape which is not attached to the photosensitive drum (referred to as a comparison tape) is also attached to the same white paper. Then, a color phase difference between the fog-sampling tape and the comparison tape is measured using spectrophotometric colorimeter "CM-2600d" (manufactured by Konica-Minolta Ltd.) having measurement diameter of 8 mm. The color-difference (L*a*b color coordinate system) is calculated according to the following equation:

$$\Delta E=(\Delta L^2+\Delta a^2+\Delta b^2)^{1/2}$$

Criteria for evaluating how the fog is improved (solved) are as follows:

| Fog Level | Range of ΔE |
|---|---|
| 5 | $0.0 \leqq \Delta E < 0.5$ |
| 4 | $0.5 \leqq \Delta E < 1.0$ |
| 3 | $1.0 \leqq \Delta E < 1.5$ |
| 2 | $1.5 \leqq \Delta E < 2.0$ |
| 1 | $2.0 \leqq \Delta E$ |

[Test 1]

In Test 1, the charging voltage is switched to −1200 V (i.e., the photosensitive drum voltage is switched to −700 V). The developing voltage is not switched from −200 V, since it is intended to increase the voltage difference between the photosensitive drum voltage and the developing voltage. In this case, the fog level is level 1, i.e., the fog is substantially not solved. The reason is considered as follows. The voltage difference between the photosensitive drum voltage and the developing voltage is −500 V (=(−700V)−(−200V)), which is larger than in the printing period, and therefore the fog-toner adhering to the developing roller 12 is effectively discarded. However, the fog-toner existing in the developing unit 2 is not discarded, and therefore a part of the fog-toner existing in the developing unit 2 passes the regulating blade 13 and reaches the photosensitive drum 1 during the printing operation so as to cause the fog.

[Test 2]

In Test 2, the regulating blade voltage is switched to −100 V. In this case, the fog level is level 3, and the fog is intermediately solved. The reason is considered as follows. The voltage difference between the regulating blade voltage and the developing voltage is +100 V (=(−100V)−(−200V)), and the polarity of electric field of the regulating blade 13 side with respect to the developing roller 12 is reversed. With this, the fog-toner in the developing unit 2 is more likely to move to the developing roller 12 and to move to the photosensitive drum 1 (i.e., to be discarded), so that the amount of discarded fog-toner increases, and the amount of fog-toner remaining in the developing unit 2 decreases.

[Test 3]

In Test 3, the regulating blade voltage is switched to −100 V, and the developing voltage is switched to −300 V. In this case, the fog level is level 4, which is enhanced compared with the Test 2. The reason is considered as follows. By switching the developing voltage as well as the regulating voltage, the polarity of the electric field of the regulating blade 13 side with respect to the developing roller 12 is reversed, and the voltage difference between the regulating blade voltage and the developing voltage increases to +200 V (=(−100V)−(−300V)). With this, the fog-toner adhering to the developing roller 12 is more likely to move to the photosensitive drum 1, so that the amount of discarded fog-toner increases.

[Test 4]

In Test 4, the regulating blade voltage is switched to −100 V, and the charging voltage is switched to −1200 V (i.e., the photosensitive drum voltage is switched to −700V). In this case, the fog level is level 4, which is substantially the same as the Test 3. The reason is considered as follows. The voltage difference between the regulating blade voltage and the developing voltage is +100 V (=(−100V)−(−200V)), and the polarity of electric field of the regulating blade 13 side with respect to the developing roller 12 is reversed. The voltage difference between the photosensitive drum voltage and the developing voltage is −500 V (=(−700V)−(−200V)), and the absolute value thereof increases. With this, the fog-toner having been moved from the developing unit 2 and adhering to the surface of the developing roller 12 is more likely to move to the photosensitive drum 1, so that the amount of discarded fog-toner increases.

[Test 5]

In Test 5, the regulating blade voltage is switched to −100 V, the developing voltage is switched to −300 V and the charging voltage is switched to −1200 V (i.e., the photosensitive drum voltage is switched to −700 V). In this case, the fog level is level 5, which is an excellent result. The reason is considered as follows. The voltage difference between the regulating blade voltage and the developing voltage is +200 V (=(−100V)−(−300V)), and the absolute value thereof further increases, while the polarity of electric field of the regulating blade 13 side with respect to the developing roller 12 is reversed. Further, the voltage difference between the photosensitive drum voltage and the developing voltage is −400 V (=(−700V)−(−300V)), and the absolute value thereof is larger than in the printing period. With this, the fog-toner existing in the developing unit 2 is more likely to move to the developing roller 12, and the fog-toner adhering to the developing roller 12 is more likely to move to the photosensitive drum 1.

[Test 6]

In Test 6, the voltage-changing period is not provided (i.e., voltages are not switched). In this case, the fog level is level 1. To be more specific, the evaluation level of the fog is worse than the above described Test 1.

In the above described Test 1, only the charging voltage is switched. The absolute value of the regulating blade voltage is not smaller than or equal to the absolute value of the developing voltage, and therefore the fog-toner can not pass the regulating blade 13.

In the above described Test 2, the absolute value of the regulating blade voltage is smaller than or equal to the absolute value of the developing voltage, and therefore the fog-toner can pass the regulating blade 13.

In the above described Test 3, the regulating blade voltage and the developing voltage are switched so that the absolute value of the regulating blade voltage is smaller than or equal to the absolute value of the developing voltage, and the voltage difference therebetween is larger than that of Test 2. Therefore, a larger amount of toner can pass the regulating blade 13.

In the above described Test 4, the regulating blade voltage and the charging voltage (i.e., the photosensitive drum voltage) are switched so that the absolute value of the regulating blade voltage is smaller than or equal to the absolute value of the developing voltage, and the voltage difference between the developing voltage and the photosensitive drum voltage increases. Therefore, the toner is more likely to pass the regulating blade 13 and is more likely to move to the photosensitive drum 1.

In the above described Test 5, the regulating blade voltage, the developing blade and the charging voltage (i.e., the photosensitive drum voltage) are switched so that the absolute value of the regulating blade voltage is smaller than or equal to the absolute value of the developing voltage and the voltage difference therebetween increases, and so that the voltage difference between the developing voltage and the photosensitive drum voltage also increases. Therefore, the toner is more likely to pass the regulating blade 13, and more likely to move to the photosensitive drum 1.

In this embodiment, the regulating blade voltage Vbl-1 for fog-toner discarding period is −100 V, and therefore the polarity of the voltage applied to the regulating blade 13 is the same as the negatively-chargeable toner. Further, the absolute value of the regulating blade voltage Vbl-1 is smaller than (or equal to) the absolute value of the developing blade. Accordingly, the reversely-charged toner and low-charge (negatively charged) toner are held on the developing roller 12 and are not attracted to the regulating blade 13. In other words, the fog-toner (i.e., reversely-charged toner and low-charge toner) passes the regulating blade 13.

The above described experimental results show merely examples of combinations of respective voltages. The voltage difference between the regulating blade voltage and the developing voltage and the voltage difference between the photosensitive drum voltage and the developing voltage relate to the movement of the fog-toner, and therefore the solution of the fog is influenced by the settings of the respective voltages. From the above described experimental results, it is conceivable that an advantage in solving the fog is obtained to some extent by switching the regulating blade voltage, and a further advantage in solving the fog is obtained by switching the developing voltage and the charging voltage (in addition to the regulating blade voltage).

Moreover, it is preferable to further switch the supplying voltage applied to the toner supplying roller 18. In such a case, the supplying voltage Vsp-0 for the printing forming period is set to, for example, −300 V, whose absolute value is larger than the developing voltage. The supplying voltage Vsp-1 for the fog-toner discarding period is, for example, −100 V, whose absolute value is smaller than the developing voltage. In this case, the fog-toner can be moved from the toner supplying roller 18 to the developing roller 12, and therefore it becomes possible to discard the fog-toner existing in the vicinity of the toner supplying roller 18.

Thus, the fog-toner in the entire developing unit 2 can be discarded by one fog-toner discarding operation, and therefore the interval between the fog-toner discarding operations can be lengthened. In other words, the interval between the voltage-changing periods can be lengthened. In this example, the regulating blade voltage and the supplying voltage are set to be the same as each other, so that the regulating blade voltage and the supplying voltage can be obtained by a common power source. Alternatively, the supplying voltage Vsp-0 for the printing period can be set to, for example, −350 V, and the supplying voltage Vsp-1 for the fog-toner discarding period can be set to, for example, −50 V, which are different from the regulating blade voltages Vbl-0 and Vbl-1.

The description of this embodiment is merely an example, and the respective voltages are not limited to those described above. The voltages can be set so as to effectively discard the fog-toner, in accordance with process conditions (such as charge characteristics of the toner or properties of the respective rollers), environmental conditions (such as temperature or humidity), voltage output range of the power source, or the like.

In this embodiment, the fog-toner discarding operation is performed when the printing operation ends during the print job. However, it is also possible to perform the fog-toner discarding operation before the printing operation starts during the print job. Alternatively, it is also possible to independently perform the fog-toner discarding operation between the print jobs. It is also possible to perform the fog-toner discarding operation for a short time on every print job. Furthermore, it is also possible to perform the fog-toner discarding operation once every 500 sheets of printing or the like. Moreover, it is also possible to provide a button to start the fog-toner discarding operation so that the fog-toner discarding operation is started by the operation by the user.

In this embodiment, the developing voltage and the charging voltage are switched to thereby generate a voltage difference sufficient for discarding the fog-toner, on the premise that the regulating blade voltage is switched. In terms of voltage difference, a modification can be made as follows.

The absolute value of the regulating blade voltage Vbl-1 for the fog-toner discarding period is smaller than the absolute value of the regulating blade voltage Vbl-0 for the printing period, and is smaller than the absolute value of the developing voltage Vdv-1 for the fog-toner discarding period, as described above (FIG. 5). In this regard, if the absolute value of the developing voltage Vbl-1 (for the fog-toner discarding period) is smaller than the absolute value of the developing voltage Vdv-O (for the printing period), it is also possible to keep the developing voltage unchanged. In other words, in the fog-toner discarding period, it is only necessary that the voltage difference between the regulating blade voltage and the developing voltage is large, and the absolute value of the regulating blade voltage is smaller than the absolute value of the developing voltage, as shown in FIG. 5. As the voltage difference is larger, the fog-toner is more likely to move to the developing roller 12.

Further, a combination of the photosensitive drum voltage and the developing voltage in the fog-toner discarding period can be variously determined as long as the absolute value of the developing voltage is smaller than the absolute value of the photosensitive drum voltage. In the example shown in FIG. 5, the photosensitive drum voltage is switched to Vdr-1 and the developing voltage is switched to Vdv-1. However, it is also possible that the photosensitive drum voltage is unchanged from Vdr-0 and the developing voltage is switched to Vdv-1. It is also possible that the photosensitive drum voltage is switched to Vdr-1 and the developing voltage is unchanged from Vdv-0. It is also possible that the photosensitive drum voltage is unchanged from Vdr-0 and the developing voltage is unchanged from Vdv-0.

In this regard, regarding the combination of the photosensitive drum voltage and the developing voltage, the fog-toner is more likely to move to the photosensitive drum 1, as the absolute value of the developing voltage is small (compared with the photosensitive drum voltage) and the voltage difference therebetween is large. Therefore, it is preferable that, in the fog-toner discarding period, the absolute value of the regulating blade voltage (|Vbl-1|), the absolute value of the developing voltage (|Vdv-1|) and the absolute value of the photosensitive drum voltage (|Vdr-1|) satisfy the following relationship:

$$|Vdr\text{-}1| > |Vdv\text{-}1| \geqq |Vbl\text{-}1|.$$

The voltage difference between the regulating blade voltage and the developing voltage, and the voltage difference between the photosensitive voltage and the developing voltage are preferably as large as possible. In this regard, the regulating blade voltage Vbl-1 can be 0V.

Further, in the fog-toner discarding period, it is also possible that the regulating blade voltage is equal to the developing voltage (i.e., the voltage difference therebetween is 0). In this case, the fog-toner on the developing roller 12 is not attracted to the regulating blade 13, and passes the regulating blade 13 while adhering to the developing roller 12. In this regard, the photosensitive drum voltage is switched by switching the charging voltage.

As described above, according to the first embodiment, the respective voltages are switched between the voltages for the printing period and the voltages for the fog-toner discarding period. In the fog-toner discarding period, the voltages are set so as to effectively cause the low-charge toner and the reversely-charged toner in the developing unit 2 to move to the developing roller 12. Therefore, the fog-toner can be effectively discarded from the developing unit 2, with the result that a high quality image with no fog can be obtained.

In this regard, in this embodiment, the regulating blade voltage is switched so that the absolute value of the regulating blade voltage Vbl-1 for the fog-toner discarding period is smaller than the absolute value of the regulating blade voltage Vbl-0 for the printing period as described above. However, a modification can be made as follows. In this modification, the developing voltage is switched so that the absolute value of the developing voltage is larger than the absolute value of the regulating blade voltage in the fog-toner discarding period. In this case, the photosensitive drum voltage is also switched so that the toner on the developing roller 12 adheres to the surface of the photosensitive drum 1.

To be more specific, in the fog-toner discarding period (in the non-image-forming period), the regulating blade voltage is not switched. Instead, the absolute value of the developing voltage is switched to be larger than the absolute value of the regulating blade voltage. For example, when the regulating blade voltage Vbl-0 for the printing period is −300 V, the regulating blade voltage Vbl-1 (=Vbl-0) for the fog-toner discarding period is also −300 V. The developing voltage Vdv-0 for the printing period is −200 V, and the developing voltage Vdv-1 for the fog-toner discarding period is −500 V. In this case, $|Vbl\text{-}1| \leqq |Vdv\text{-}1|$ is satisfied.

In this regard, since the photosensitive drum voltage Vdr-0 is −500 V and since the photosensitive drum voltage and the developing voltage preferably satisfy the relationship $|Vdr\text{-}1| > |Vdv\text{-}1|$, the charging voltage is set to, for example, −1400 V so that the photosensitive drum voltage Vdr-1 is −900 V.

As described above, when the relationship $|Vbl\text{-}1| \leqq |Vdv\text{-}1|$ is satisfied, the fog-toner is not attracted to the regulating blade 13. Further, when the relationship $|Vdr\text{-}1| > |Vdv\text{-}1|$ is satisfied, the fog-toner passing the regulating blade 13 can move to the photosensitive drum 1 side, i.e., to be discarded. Therefore, when $|Vdr\text{-}1| > |Vdv\text{-}| \geqq |Vbl\text{-}1|$ is satisfied, the fog-toner existing in the developing unit 2 can be discarded. For this reason, the above described embodiment and the modification thereof are merely examples, and the regulating blade voltage, the developing voltage and the photosensitive drum voltage can be set as necessary so as to satisfy the relationship: $|Vdr\text{-}1| > |Vdv\text{-}1| \geqq |Vbl\text{-}1|$.

In this regard, when the regulating blade voltage Vbl-1 is the same as the developing voltage Vdv-1, the voltage difference therebetween is 0. Therefore, the fog-toner on the surface of the developing roller 12 is not attracted to the regulating blade 13, and passes the regulating blade 13 while adhering to the developing roller 12. For this reason, the fog-toner is not attracted to the regulating blade 13 as long as the following relationship is satisfied: $|Vbl\text{-}1| \leqq |Vdv\text{-}1|$.

Second Embodiment

Next, the second embodiment of the present invention will be described. Components that are the same as those of the first embodiment are assigned the same reference numerals, and explanations thereof will be omitted. With regard to operations and advantages that are the same as those of the first embodiment, explanations thereof will be omitted.

Figure 11:
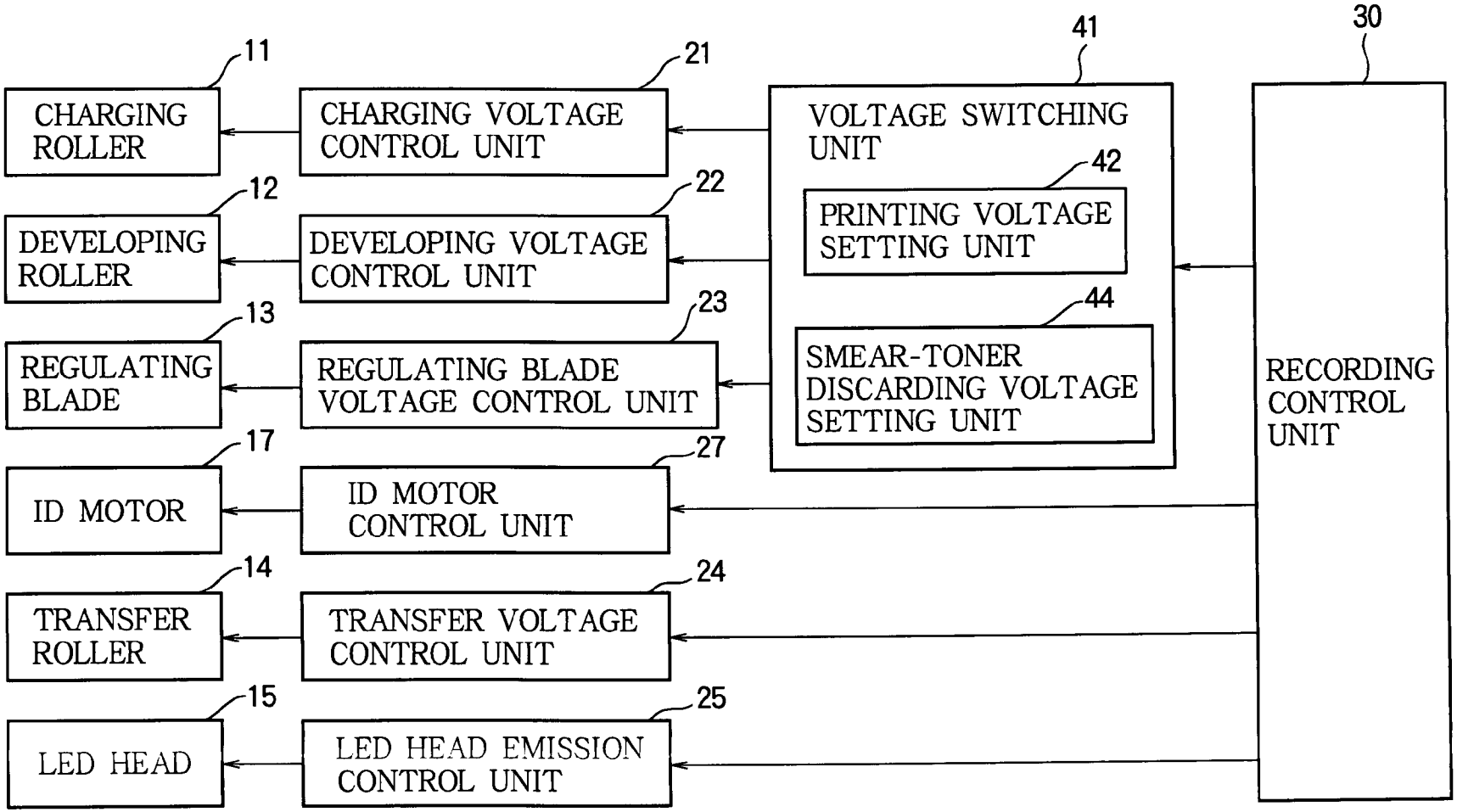
FIG. 11 is a block diagram showing a configuration of a control system of an image forming apparatus according to the second embodiment of the present invention.

FIG. 11 is a block diagram showing a control system of an image forming apparatus according to the second embodiment of the present invention.

In the first embodiment, a configuration for discarding the fog-toner has been described. However, in a low humidity environment (for example, at the humidity of 10%), an excessively charged toner (i.e., a high-charge toner) may cause a smear. Therefore, in this second embodiment, a configuration for discarding such smear-toner will be described.

As shown in FIG. 11, in the second embodiment, the charging voltage control unit 21, the developing voltage control unit 22 and the regulating blade control unit 23 are connected to a voltage switching unit 41. The voltage switching unit 41 includes a printing voltage setting unit 42 and a smear-toner discarding voltage setting unit 44. According to the instruction from a recording control unit 30, the voltage switching unit 41 switches between voltages for printing period (held in the printing voltage setting unit 42) and voltages for smear-toner discarding period (held in the smear-toner discarding voltage setting unit 44), which are notified to the charging voltage control unit 21, the developing voltage control unit 22 and the regulating blade voltage control unit 23. The charging voltage control unit 21, the developing voltage control unit 22 and the regulating blade voltage control unit 23 output voltages according to voltage settings notified by the voltage switching unit 41.

The other configurations are the same as the first embodiment, and therefore explanation thereof will be omitted.

Next, an operation of the image forming apparatus 100 of the second embodiment will be described. In this regard, a printing operation is the same as that of the first embodiment, and therefore explanation thereof will be omitted.

Further, the distribution of electric charge of the toner in the toner layer on the developing roller 12 is the same as that of the first embodiment (FIG. 4). To be more specific, after the low density printing is performed, the width of the distribution of the electric charge is widened, and the existing probability of the low-charge toner and high-charge toner increases.

In the printing process, when the high-charge toner adheres to the photosensitive drum 1, a voltage difference between the toner and the non-exposed area of the photosensitive drum 1 is small. Therefore, if the distribution of the electric charge is shifted to higher side, the probability that the toner adheres to non-image area of the recording medium 3 increases. The phenomenon where the high-charge toner (having electric charge larger than normally charged toner) adheres to a background of the image (i.e., non-image area) is referred to as a "smear". The high-charge toner that may cause the smear is referred to as a "smear-toner" (i.e., a smear-causing developer). The smear-toner also includes a toner that tends to be excessively charged to become the high-charge toner (referred to as easily-chargeable toner).

In this embodiment, the charging voltage, the developing voltage and the regulating voltage are switched from the voltages for the printing period to the voltages for the smear-toner discarding period to thereby selectively discard the smear-toner (i.e., high-charge toner or easily-chargeable toner) during a period other then the printing period. In other words, the charging voltage, the developing voltage and the regulating voltage are switched from the voltages for the image forming period to the predetermined voltages for the non-image-forming period, so as to effectively discard the smear-toner from the developing unit 2.

As was described in the first embodiment, "image forming operation" means an operation for forming a toner image using a normally-charged toner on the photosensitive drum 1, and includes a printing operation for forming a toner image (to be transferred to the recording medium 3) based on image data, and a forming operation of a compensation pattern such as a color shift compensation pattern and an image density compensation pattern. The charging voltage, the developing voltage, the regulating blade voltage and the supplying voltage for these operations are voltages for image forming period (to be more specific, voltages for the printing period).

Further, the term "non-image-forming operation" means operations other than the above described image forming operation. A "smear-toner discarding period" is provided as a certain period in a non-image-forming period (i.e., a period for non-image-forming operation). The smear-toner discarding period is a voltage-varying period in which the voltages are switched from voltages for the image-forming period. In other words, the voltage-varying period is a part of the non-image-forming period. In this regard, the voltage-varying period can be provided in any period in the non-image-forming period while the image forming apparatus 100 is driven.

Next, a relationship between the photosensitive drum voltage, the developing voltage and the regulating blade voltage for the smear-toner discarding period will be described.

Figure 12:
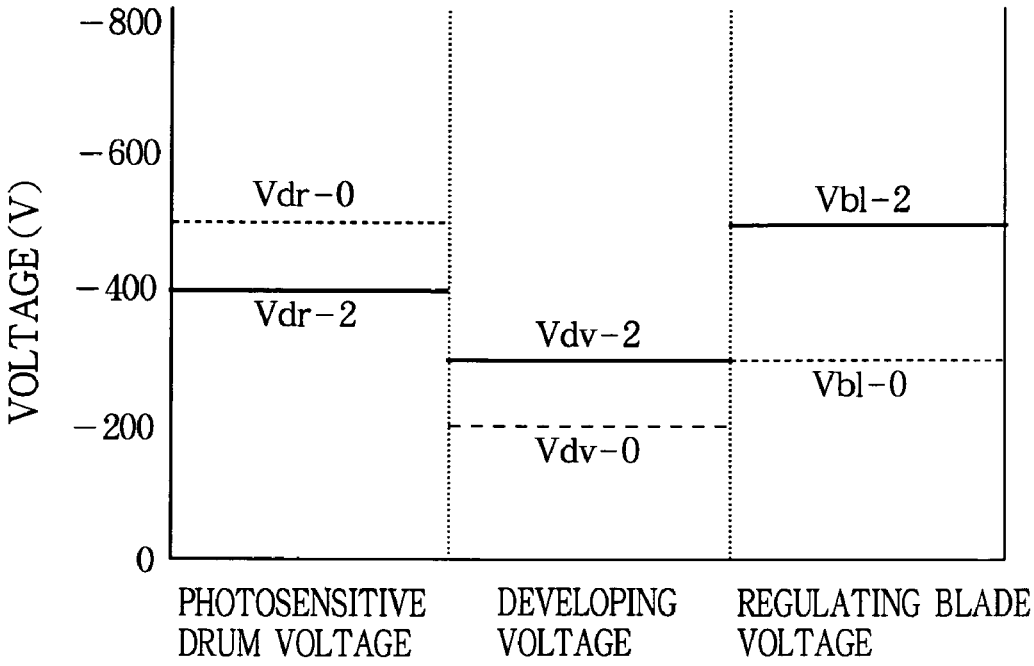
FIG. 12 is a graph showing a relationship between a photosensitive drum voltage, a developing voltage and a regulating blade voltage in a smear-toner discarding period according to the second embodiment of the present invention.

FIG. 12 is a graph showing the relationship between the photosensitive drum voltage, the developing voltage and the regulating blade voltage according to the second embodiment of the present invention.

In FIG. 12, examples of the photosensitive drum voltage, the developing voltage and the regulating blade voltage during the smear-toner discarding period are shown by solid lines, compared with respective voltages (shown by dashed lines) for printing period.

In the printing period (in an ordinary printing process), the regulating blade voltage Vbl-0 is set to −300 V and the developing voltage Vdv-0 is set to −200 V so that the voltage difference therebetween is −100 V (=(−300V)−(−200V)), as was described in the first embodiment. Further, the photosensitive drum voltage Vdr-0 is set to −500 V so that the voltage difference between the photosensitive drum voltage Vdr-0 and the developing voltage Vdv-0 is −300 V (=(−500V)−(−200V)). The voltage difference between the latent image potential Vdv-e and the developing voltage Vdv-0 is +100 V(=(−100V)−(−200V)), so that the latent image is developed.

In contrast, during the smear-toner discarding period in the non-image-forming period, the voltage difference between the regulating blade voltage Vbl-2 and the developing voltage Vdv-2 increases, compared with in the printing period. With this, a large electric field is formed, in which the polarity of the regulating blade 13 side with respect to the developing blade 12 is the same as the normally charged toner. Therefore, a reversely-charged toner (not a smear-toner) is attracted to the regulating blade 13. Instead, the high-charge toner is held on the developing roller 12 (i.e., not attracted to the regulating blade 13), and easily passes the regulating blade 13. Further, an easily-chargeable toner is imparted with electric charge due to the regulating blade voltage, and passes the regulating blade 13. Therefore, the probability that the smear-toner in the developing unit 2 passes the regulating blade 13 increases.

In this embodiment, the regulating blade voltage Vbl-2 in the smear-toner discarding period is −500 V and the developing voltage Vdv-2 in the smear-toner discarding period is set to −300 V, so that the voltage difference between the regulating blade voltage Vbl-2 and the developing voltage Vdv-2 is −200V (=(−500V)−(−300V)).

Next, the distribution of electric charge of the toner in the toner layer of the developing roller 12 in the smear-toner discarding period will be described.

Figure 13:
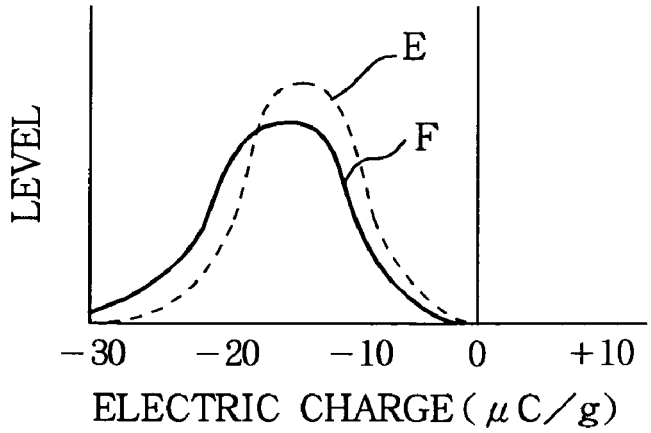
FIG. 13 is a graph showing a distribution of electric charge of the toner in the toner layer on the developing roller in the smear-toner discarding period according to the second embodiment of the present invention.
Figures 14A, 14B, 14C, 14D, 14E, 14F:
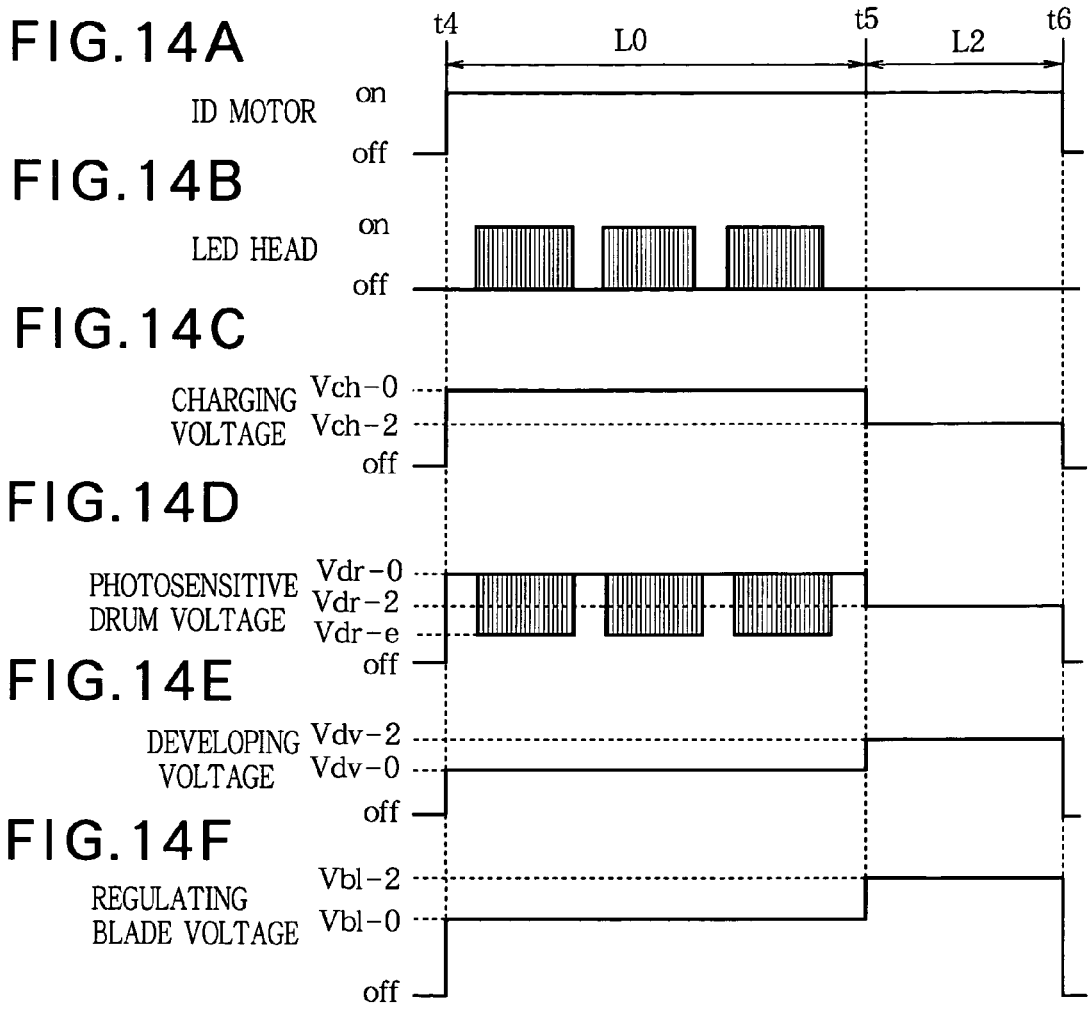
FIGS. 14A through 14F show a timing chart illustrating operation timings of respective parts according to the second embodiment of the present invention.
Figures 15A, 15B, 15C, 15D, 15E, 15F:
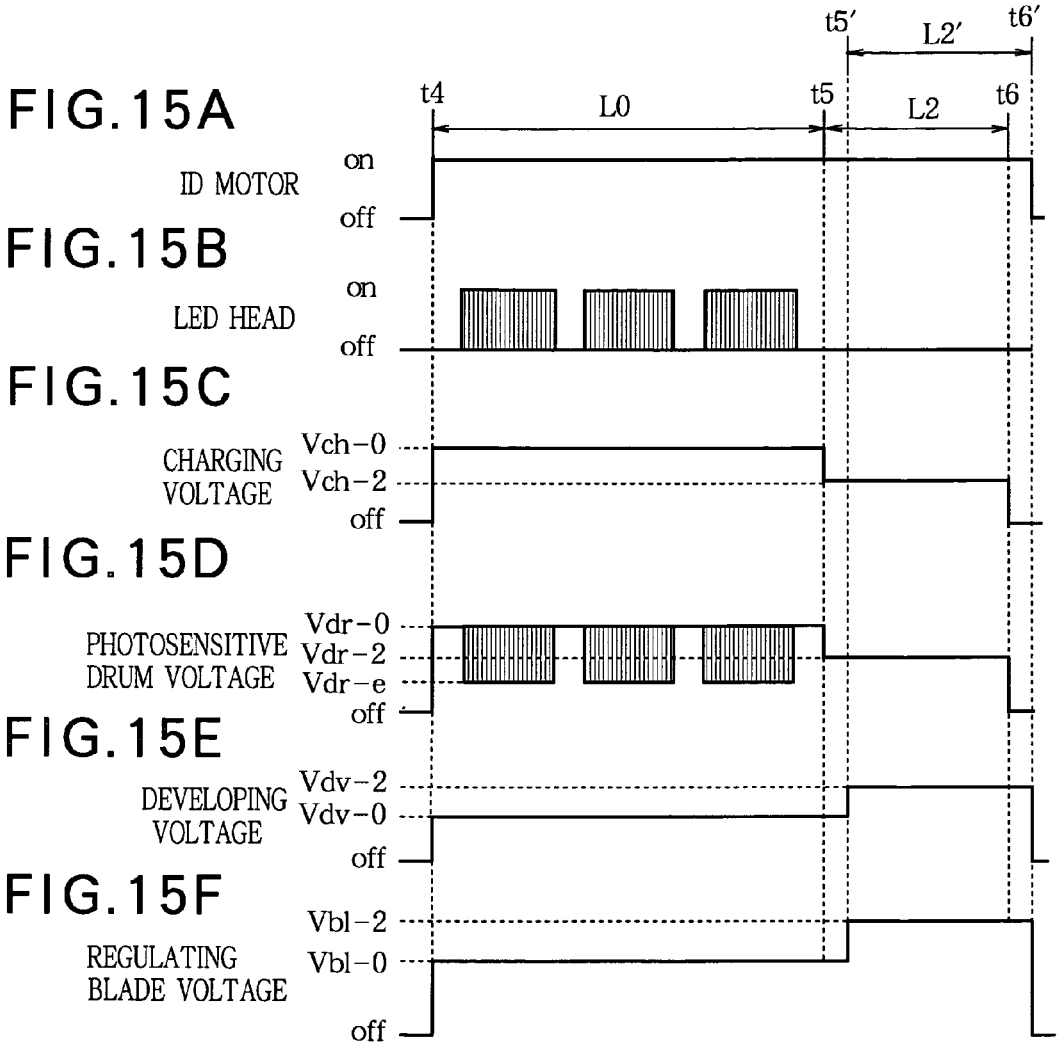
FIGS. 15A through 15F show a timing chart illustrating operation timings of respective parts according to another example of the second embodiment of the present invention.

FIG. 13 is a graph showing the distribution of electric charge of the toner in the toner layer of the developing roller 12 in the smear-toner discarding period according to the second embodiment.

FIG. 13 shows the distribution in the smear-toner discarding period (i.e., when the voltages for the smear-toner discarding period are set) and the distribution of electric charge of the toner in the toner layer on the developing roller in the printing period (i.e., when the voltages for the printing period are set). The distribution of electric charge of the toner during the smear-toner discarding period shown by a solid line F is shifted to higher side (i.e., left side in FIG. 13), compared with the printing period show by a dashed line E. Therefore, it is understood that the existing probability of the high-charge toner increases in the smear-toner discarding operation period. It is thus understood that the probability that the smear-toner in the developing unit 2 passes the developing blade 13 and moves to the surface of the developing roller 12 increases.

Further, in the smear-toner discarding period, the voltage difference between the photosensitive drum voltage Vdr-2 and the developing voltage Vdv-2 is smaller than in the printing period. With this, the probability that the smear-toner (adhering to the developing roller 12) is electrically attracted to the photosensitive drum 1 and moves to the photosensitive drum 1 increases. In this regard, if the voltage difference between the photosensitive drum voltage Vdr-2 and the developing voltage Vdv-2 is excessively small, the normally charged toner also moves to the photosensitive drum 1. Therefore, the voltage difference between the photosensitive drum voltage Vdr-2 and the developing voltage Vdv-2 is preferably set to a voltage difference that selectively causes the smear-toner to move to the photosensitive drum 1.

In this embodiment, the photosensitive drum voltage Vdr-2 is set to −400 V and the developing voltage Vdv-2 is set to −300 V so that the voltage difference between the photosensitive drum voltage Vdr-2 and the developing voltage Vdv-2 is −100 V (=(−400V)−(−300V)). In order to obtain the photosensitive drum voltage Vdr-2 of −400V, the charging roller 11 is applied with the charging voltage Vch-2 of −900 V.

Next, operation timings of the respective parts in the smear-toner discarding period will be described.

FIGS. 14A through 14F show a timing chart illustrating operation timings of the ID motor 17, the light emission of the LED head 15, the charging voltage, the photosensitive drum voltage, the developing voltage and the regulating blade voltage in the fog-toner discarding period according to the second embodiment of the present invention.

First, a print job is started in response to print job starting signal sent from the recording control unit 30, and the ID motor 17 is turned on (t4). This causes the photosensitive drum 1, the charging roller 11, the developing roller 12 and the toner supplying roller 18 to start rotating. The charging voltage Vch-0 for the printing period is applied to the charging roller 11 in synchronization with the starting of the rotation. By the application of the charging voltage Vch-0 for the printing period, the surface of the photosensitive drum 1 is charged to the photosensitive drum voltage Vdr-0 for the printing period. At the same time (at the timing t4), the developing voltage Vdv-0 for the printing period is applied to the developing roller 12, and the regulating blade voltage Vbl-0 for the printing period is applied to the regulating blade 13. With this, a printing period L0 is started.

Subsequently, the LED head 15 starts light emitting operation according to page synchronization signal and image data. When the LED head 15 emits light, the electric potential of the irradiated area of the photosensitive drum 1 is lowered to a latent image potential Vdr-e, and a latent image is formed. The latent image is developed by the toner, with the result that the toner image is formed. When the LED head 15 completes the light emitting operation, the printing period L0 ends (t5).

At the timing t5, the charging voltage is switched to the charging voltage Vch-2 for the smear-toner discarding period while the ID motor 17 is kept turned on. By the switching of the charging voltage, the photosensitive drum voltage is switched to the photosensitive drum voltage Vdr-2 for the smear-toner discarding period. Furthermore, at the timing t2, the developing voltage is switched to the developing voltage Vdv-2 for the smear-toner discarding period, and the regulating blade voltage is switched to the regulating blade voltage Vbl-2 for the smear-toner discarding period. With this, the smear-toner discarding period L2 is started.

Here, description has been made to the example where the developing voltage and the regulating blade voltage and switched at the same time as the charging voltage. However, a time delay can be provided therebetween corresponding to a time for the photosensitive drum 1 to rotate a distance between the charging roller 11 and the developing roller 12 along the circumference of the photosensitive drum 1.

The smear-toner discarding period (L2) continues to a timing t6. At the timing t6, the ID motor 17, the charging voltage, the developing voltage, the photosensitive voltage and the regulating blade voltage are turned off. With this, the print job is completed, and an off-state continues until next print job is received. In this regard, during the above described smear-toner discarding period (L2), the light emission of the LED head 15 is turned off, and no latent image is formed on the photosensitive drum 1.

As the smear-toner discarding period (L2) is longer, the amount of the discarded smear-toner increases.

However, as the smear-toner discarding period (L2) is longer, the revolution of the photosensitive drum 1 increases, and therefore the lifetime of the photosensitive drum 1 is shortened and the printing throughput becomes low. Therefore, it is necessary to suitably adjust the length of the smear-toner discarding period (L2) according to application of the image forming apparatus 100 or the like. The smear-toner discarding period (L2) is preferably longer than a sum of a time required for the developing roller 12 to rotate by one rotation and a time required for the toner supplying roller 18 to rotate by one rotation.

As above, the preferable example of the operation timings of the respective parts in the smear-toner discarding period has been described.

Next, another preferable example of the operation timings of the respective parts in the smear-toner discarding period will be described.

FIGS. 15A through 15F show a timing chart illustrating operation timings of the ID motor 17, the light emission of the LED head 15, the charging voltage, the photosensitive drum voltage, the developing voltage and the regulating blade voltage in the fog-toner discarding period according to another example of the second embodiment of the present invention. FIGS. 16A through 16F are schematic views showing the relationship between the photosensitive drum, the developing roller and the charging roller in the smear-toner discarding period according to the example shown in FIGS. 15A through 15F.

First, a print job is started in response to print job starting signal from the recording control unit 30, and the ID motor 17 is turned on (t4). This causes the photosensitive drum 1, the charging roller 11, the developing roller 12 and the toner supplying roller 18 to start rotating. The charging voltage Vch-0 for the printing period is applied to the charging roller 11 in synchronization with the starting of the rotation. By the application of the charging voltage Vch-0 for the printing period, the surface of the photosensitive drum 1 is charged to the photosensitive drum voltage Vdr-0 for the printing period. At the same time (at the timing t4), the developing voltage Vdv-0 for the printing period is applied to the developing roller 12, and the regulating blade voltage Vbl-0 for the printing period is applied to the regulating blade 13. With this, a printing period L0 is started.

Subsequently, the LED head 15 starts light emitting operation according to page synchronization signal and image data. When the LED head 15 emits light, the electric potential of the irradiated area of the photosensitive drum 1 is lowered to a latent image potential Vdr-e and a latent image is formed. The latent image is developed by the toner, with the result that the toner image is formed. When the LED head 15 completes the light emitting operation of, the printing period L0 ends (t5).

Figure 16A:
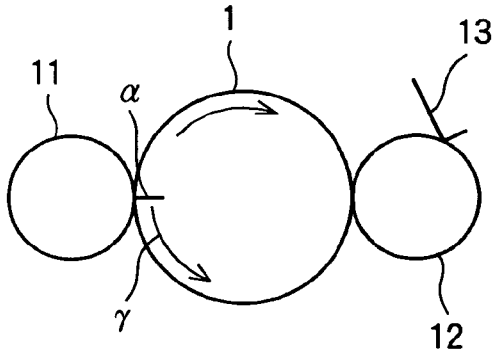
FIGS. 16A through 16E are schematic views showing a relationship between a photosensitive drum, a developing roller and a charging roller in the smear-toner discarding period according to the example shown in FIGS. 15A through 15F.

At the timing t5, the photosensitive drum 1, the charging roller 11 and the developing roller 12 are respectively at positions as shown in FIG. 16A. Here, a position α is defined as a position on the photosensitive drum 1 that faces the charging roller 11 at the timing t5. At the timing t5, the charging voltage is switched to Vch-2. Thereafter, an area γ on the downstream side of the position α on the surface of the photosensitive drum 1 has a surface potential of Vdr-2.

Figure 16B:
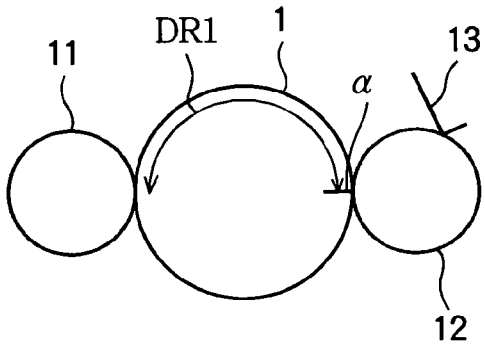

Further, when the photosensitive drum 1 is further rotates (t2'), the photosensitive drum 1, the charging roller 11 and the developing roller 12 are respectively at positions as shown in FIG. 16B. In this state, the position α on the photosensitive drum 1 faces the developing roller 12. At the timing t5', the developing voltage is switched to Vdv-2. Thereafter, when an area DR1 on the downstream side of the position α (on the surface of the photosensitive drum 1) faces the developing roller 12, the smear-toner (on the developing roller 12) adheres to the surface of the surface of the photosensitive drum 1.

Figure 16C:
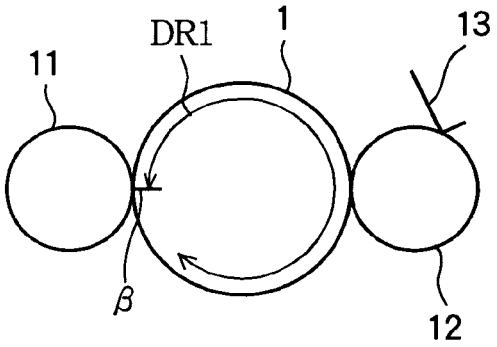

Further, at a timing t6, the photosensitive drum 1, the charging roller 11 and the developing roller 12 are respectively at positions as shown in FIG. 16C. A position β is defined as a downstream end of the area DR1. When the position β faces the charging roller 11, the charging voltage is turned off. In this regard, if the printing is continuously performed (for example, in the case where the image forming apparatus 100 receives next print job), the charging voltage is switched to Vch-0.

Figure 16D:
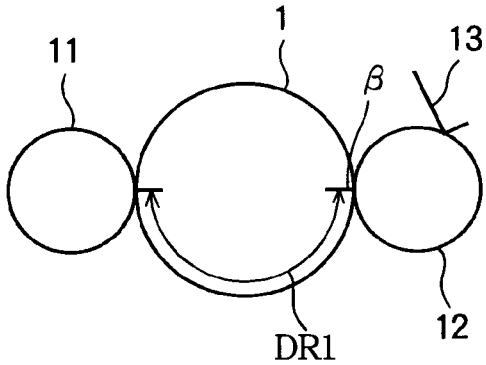

Further, at a timing t6', the photosensitive drum 1, the charging roller 11 and the developing roller 12 are respectively at positions as shown in FIG. 16D. When the position β faces the developing roller 12, the developing voltage is turned off, and the smear-toner discarding period ends.

Figure 16E:
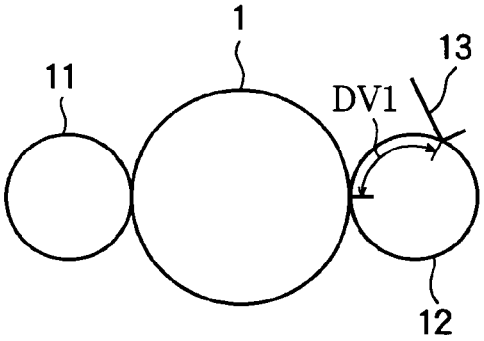

The timing of the switching of the regulating blade voltage is the same as the timing of the switching of the developing voltage. However, as shown in FIG. 16E, the regulating blade voltage can be switched at a different timing from the switching of the developing voltage in accordance with a distance DV1 between a position where the developing roller 12 faces the photosensitive drum 1 and a position where the developing roller 12 faces the regulating blade 13. It is also possible that the ID motor 17 is turned off after the timing t6' (i.e., when the developing voltage and the regulating blade voltage are turned off).

Next, an experimental in which the smear-toner discarding operation is performed while changing respective voltages will be described.

FIG. 17 is a table showing experimental results according to the second embodiment of the present invention.

In this experiment, the smear-toner discarding operation is performed while varying a combination of the regulating blade voltage, the developing voltage and the charging voltage. The printing is performed after the smear-toner discarding operation, and how the smear on the recording medium 3 is improved (compared with smear on the recording medium 3 printed before the smear-toner discarding operation) is visually evaluated. The evaluation results are shown in FIG. 17.

The regulating blade voltage, the developing voltage and the charging voltage are switched as shown in FIG. 12. During the printing period, the charging voltage is −1000 V, the photosensitive drum voltage is −500 V, the developing voltage is −200 V and the regulating blade voltage is −300 V.

The measurement of the smear is performed as follows. The image forming apparatus 100 is stopped while the image forming apparatus 100 is performing a printing of image density of 0%. Further, an adhesion tape "Scotch Mending Tape" (manufactured by Sumitomo 3M Ltd.), which is referred to as a smear-sampling tape, is attached to the surface of the photosensitive drum 1 after development of the latent image and before transferring of the developed image. Then, the smear-sampling tape (to which the toner adheres) is attached to a white paper. For comparison, an adhesion tape which is not attached to the photosensitive drum (referred to as a comparison tape) is also attached to the same white paper. Then, a color phase difference between the smear-sampling tape and the comparison tape is measured using spectrophotometric colorimeter "CM-2600d" (manufactured by Konica-Minolta Ltd.) having measurement diameter of 8 mm. The color-difference (L*a*b color coordinate system) is calculated according to the following equation:

$$\Delta E=(\Delta L^2+\Delta a^2+\Delta b^2)^{1/2}$$

Criteria for evaluating how the smear is improved (solved) are as follows:

| Fog Level | Range of ΔE |
|---|---|
| 5 | 0.0 ≦ ΔE < 0.5 |
| 4 | 0.5 ≦ ΔE < 1.0 |
| 3 | 1.0 ≦ ΔE < 1.5 |
| 2 | 1.5 ≦ ΔE < 2.0 |
| 1 | 2.0 ≦ ΔE |

[Test 1]

In Test 1, the charging voltage is switched to −900 V (i.e., the photosensitive drum voltage is switched to −400V), and the developing voltage is −300 V. In this case, the smear level is level 1, i.e., the smear is substantially not solved. The reason is considered as follows. The voltage difference between the photosensitive drum voltage and the developing voltage is −100 V (=(−400V)−(−300V)), which is smaller than in the printing period, and therefore the smear-toner adhering to the developing roller 12 moves to the photosensitive drum 1 and is discarded. However, the smear-toner existing in the developing unit 2 is not discarded, and therefore a part of the smear-toner existing in the developing unit 2 passes the regulating blade 13 and reaches the photosensitive drum 1 during the printing operation so as to cause the smear.

[Test 2]

In Test 2, the regulating blade voltage is switched to −500 V. In this case, the smear level is level 3, and the smear is intermediately solved. The reason is considered as follows. The voltage difference between the regulating blade voltage and the developing voltage is −300 V (=(−500V)−(−200V)), so as to form a large electric field in which the polarity of the regulating blade 13 side with respect to the developing blade 12 is the same as the normally charged toner. With this, the smear-toner in the developing unit 2 is more likely to adhere to the developing roller 12 and more likely to move to the photosensitive drum 1 (i.e., to be discarded), so that the amount of discarded smear-toner increases.

[Test 3]

In Test 3, the regulating blade voltage is switched to −500 V, and the developing voltage is switched to −300 V. In this case, the smear level is level 4, which is enhanced compared with the Test 2. The reason is considered as follows. Since the voltage difference between the regulating blade voltage and the developing voltage is −200 V (=(−500V)−(−300V)) which is larger than that in the printing period, the smear-toner in the developing unit 2 is more likely to adhere to the developing roller 12. Further, since the voltage difference between the photosensitive drum voltage and the developing voltage is −200 V (=(−500V)−(−300V)) which is smaller than that in the printing period, the smear-toner adhering to the developing roller 12 is more likely to move to the photosensitive drum 1, so that the amount of discarded smear-toner increases.

[Test 4]

In Test 4, the regulating blade voltage is switched to −500V, and the charging voltage is switched to −900 V (the photosensitive drum voltage is switched to −400 V). In this case, the smear level is level 4, which is substantially the same as Test 3. The reason is considered as follows. The voltage difference between the regulating blade voltage and the developing voltage is −300 V (=(−500V)−(−200V)) which is larger than in the printing period, and the voltage difference between the regulating blade voltage and the developing voltage is −200 V (=(−400V)−(−200V)) which is smaller than in the printing period. With this, the smear-toner adhering to the developing roller 12 (having moved from the developing unit 2) is more likely to move to the photosensitive drum 1, so that the amount of discarded smear-toner increases.

[Test 5]

In Test 5, the regulating blade voltage is switched to −500 V, the developing voltage is switched to −300 V and the charging voltage is switched to −900 V (the photosensitive drum voltage is switched to −400 V). In this case, the smear level is level 5, which is an excellent result. The reason is considered as follows. The voltage difference between the regulating blade voltage and the developing voltage is −200 V (=(−500V)−(−300V)) which is larger than in the printing period. Further, the voltage difference between the photosensitive drum voltage and the developing voltage is −100 V (=(−400V)−(−300V)) which is smaller than in the printing period. With this, the smear-toner existing in the developing unit 2 is more likely to move to the developing roller 12, and the smear-toner adhering to the developing roller 12 is more likely to move to the photosensitive drum 1. Therefore, the amount of discarded smear-toner increases.

[Test 6]

In Test 6, the voltage-changing period is not provided. In this case, the smear level is level 1. To be more specific, the evaluation of the smear is worse than the above described Test 1.

In the above described Test 1, the developing voltage and the charging voltage are switched. However, the voltage difference between the regulating blade voltage and the developing voltage does not increase, and therefore the smear-toner can not pass the regulating blade 13.

In the above described Test 2, the voltage difference between the regulating blade voltage and the developing voltage increases, and therefore the smear-toner is likely to pass the regulating blade 13.

In the above described Test 3, the regulating blade voltage and the developing voltage are switched so that the voltage difference between the regulating blade voltage and the developing voltage is larger than in the printing period, and the voltage difference between the developing voltage and the photosensitive drum voltage is smaller than in the printing period. With this, the smear-toner is more likely to pass the regulating blade 13 and more likely to adhere to the photosensitive drum 1. (For comparison, as the voltage difference between the developing voltage and the photosensitive drum voltage is large, the smear-toner is less likely to move to the photosensitive drum 1.)

In the above described Test 4, the regulating blade voltage and the charging voltage (i.e., the photosensitive drum voltage) are switched so that the voltage difference between the developing voltage and the photosensitive drum voltage is smaller than Test 2. Therefore, the smear-toner is more likely to adhere to the photosensitive drum 1. (For comparison, as the voltage difference between the developing voltage and the photosensitive drum voltage is large, the smear-toner is less likely to move to the photosensitive drum 1.)

In the above described Test 5, the regulating blade voltage, the developing blade and the charging voltage are switched. With this, the smear-toner is more likely to pass the regulating blade 13, and the smear-toner is more likely to adhere to the photosensitive drum 1. (For comparison, as the voltage difference between the developing voltage and the photosensitive drum voltage is large, the smear-toner is less likely to move to the photosensitive drum 1.)

In this embodiment, the regulating blade voltage Vbl-2 is set to −500 V and the photosensitive drum voltage Vdr-2 is set to −400 V, and therefore the absolute value of the photosensitive drum voltage is smaller than the absolute value of the regulating blade voltage. Therefore, electric charge is imparted (from the regulating blade 13) to the low-charge toner or reversely-charged toner on the developing roller 12. In contrast, electric charge is not imparted (from the photosensitive drum 1) to the normally charged toner that remains on the developing roller 12 without moving to the photosensitive drum 1, and therefore such normally charged toner is not excessively charged.

Further, even if the smear-toner separates from the surface of the developing roller 12 on the upstream side of the contact portion between the developing roller 12 and the photosensitive drum 1, such smear-toner is attracted to the photosensitive drum 1 (not attracted to the regulating blade 13).

Furthermore, the smear-toner having passed the regulating blade 13 and being held on the developing roller 12 moves to the photosensitive drum 1 since the absolute value of the photosensitive drum voltage is smaller than the absolute value of the regulating blade voltage. Therefore, the smear-toner is more likely to pass the regulating blade 13 and more likely to move to the photosensitive drum 1.

The above described experimental results show merely examples of combinations of the voltages. The voltage difference between the regulating blade voltage and the developing voltage, and the voltage difference between the photosensitive drum voltage and the developing voltage relate to the movement of the smear-toner, and therefore the solution of the smear is influenced by the respective voltages.

From the above described experimental results, it is conceivable that an advantage in solving the smear is obtained to some extent by switching the regulating blade voltage, and a further advantage in solving the smear is obtained by switching the developing voltage and the charging voltage (in addition to the regulating blade voltage).

Moreover, it is preferable to further switch the supplying voltage applied to the toner supplying roller 18. In such a case, the supplying voltage Vsp-0 for the printing period is set to, for example, −300 V, which is higher than the developing voltage. The supplying voltage Vsp-2 for the smear-toner discarding period is, for example, −500 V, whose absolute value is larger than the developing voltage and whose voltage difference from the developing voltage is large. In this case, the smear-toner can be moved to the developing roller 12 from the toner supplying roller 18, and therefore it becomes possible to discard the smear-toner in the vicinity of the toner supplying roller 18.

Thus, the smear-toner in the entire developing unit 2 can be discarded by one smear-toner discarding operation, and therefore the interval between the smear-toner discarding operations can be lengthened. In other words, the interval between the voltage-changing periods can be lengthened. In this example, the supplying voltage and the regulating blade voltage are the same as each other, so that the regulating blade voltage and the supplying voltage can be obtained by a common power source. Alternatively, the supplying voltage Vsp-0 for the printing period can be set to, for example, −350 V, and the supplying voltage Vsp-2 for the smear-toner discarding period can be set to, for example, −550 V, which are different from the regulating blade voltages Vbl-0 and Vbl-2.

The description of this embodiment is merely an example, and the respective voltages are not limited to those described above. The voltages can be set so as to effectively discard the smear-toner, in accordance with process conditions (such as charge characteristics of the toner or properties of the respective rollers), environmental conditions (such as temperature or humidity), voltage output range of the power source, or the like.

In this embodiment, the smear-toner discarding operation is performed when the printing operation ends during the print job. However, it is also possible to perform the smear-toner discarding operation before the printing operation starts during the print job. Alternatively, it is also possible to independently perform the smear-toner discarding operation between the print jobs. It is also possible to perform the smear-toner discarding operation for a short time on every print job. Furthermore, it is also possible to perform the smear-toner discarding operation once every 500 sheets of printing or the like. Moreover, it is also possible to provide a button to start the smear-toner discarding operation so that the smear-toner discarding operation is started by the operation by the user.

In this embodiment, the developing voltage and the charging voltage are switched to thereby generate a voltage difference sufficient for discarding the smear-toner, on the premise that the regulating blade voltage is switched. In terms of voltage difference, a modification can be made as follows.

In the smear-toner discarding period, the absolute value of the regulating blade voltage Vbl-2 is greater than the absolute value of the developing voltage, and the voltage difference (between the regulating blade voltage and the developing voltage) is greater than in the printing period. Therefore, the smear-toner is more likely to move to the developing roller 12, compared with the printing period.

Further, in the smear-toner discarding period, the absolute value of the photosensitive drum voltage is larger than the absolute value of the developing voltage, and the voltage difference therebetween is smaller than in the printing period. Therefore, the high-charge toner is selectively moved to the photosensitive drum 1 while the normally charged toner is held on the developing roller 12, and the high-charge toner is more likely to move to the photosensitive drum 1 compared with the printing period.

Therefore, a combination of the regulating blade voltage, the photosensitive drum voltage and the developing voltage for the smear-toner discarding period can be variously determined as long as the absolute value of the photosensitive drum voltage is larger than the absolute value of the developing voltage, the absolute value of the regulating blade voltage is larger than the absolute value of the developing voltage, and the voltage difference between the regulating blade voltage and the developing voltage is larger than in the printing period. It is further preferable that the voltage difference between the photosensitive drum voltage and the developing voltage is smaller than in the printing period. In this regard, the photosensitive drum voltage is switched by switching the charging voltage.

As described above, according to the second embodiment, the respective voltages are switched between the voltages for the printing period and the voltages for the smear-toner discarding period. In the smear-toner discarding period, the voltages are set so as to effectively cause the high-charge toner and the easily-chargeable toner in the developing unit 2 to move to the developing roller 12. Therefore, the smear-toner can be effectively discarded from the developing unit 2, with the result that a high quality image with no smear can be obtained.

In this regard, in this embodiment, the regulating blade voltage is switched so that the absolute value of the regulating blade voltage Vbl-2 for the smear-toner discarding period is larger than the absolute value of the regulating blade voltage Vbl-0 for the printing period as described above. However, a modification can be made as follows. In this modification, the regulating blade voltage is not switched, but the developing voltage is switched so that the absolute value of the developing voltage is smaller than the absolute value of the regulating blade voltage in the smear-toner discarding period. In this case, the photosensitive drum voltage is also switched so that the toner on the developing roller 12 adheres to the surface of the photosensitive drum 1.

To be more specific, in the smear-toner discarding period (in the non-image-forming period), the regulating blade voltage is not switched. Instead, the developing voltage is switched so that the voltage difference between the regulating blade voltage and the developing voltage increases. For example, the regulating blade voltage Vbl-0 for the printing period is −300 V, and the regulating blade voltage Vbl-2 for the smear-toner discarding period is −300 V (=Vbl-0). The developing voltage Vdv-0 for the printing period is −200 V, and the developing voltage Vdv-2 for the smear-toner discarding period is −100 V. In this case, the following relationship is satisfied: |Vbl-2|>|Vdv-2|.

In this regard, since the photosensitive drum voltage Vdr-0 is −500 V and since the voltage difference between the developing voltage and the photosensitive drum voltage is preferably smaller than in the printing period, the charging voltage is set to, for example, −700 V so that the Vdr-2 is −200 V.

When the relationship |Vbl-2|>|Vdv-2| is satisfied, and when the voltage difference therebetween is larger in the smear-toner discarding period than in the printing period, the smear-toner is not attracted to the regulating blade 13. Further, when the relationship |Vdr-2|>|Vdv-2| is satisfied, and when the voltage difference therebetween is smaller in the smear-toner discarding period than in the printing period, the smear-toner having passed the regulating blade 13 can move to the photosensitive drum 1. Therefore, the smear-toner in the developing unit 2 can be discarded when the relationships |Vbl-2|>|Vdv-2| and |Vdr-2|>|Vdv-2| are satisfied. For this reason, the second embodiment and its modification are merely examples, and it is only necessary to switch between the voltages for the image forming period (the printing period) and the voltages for the non-image-forming period (the smear-toner discarding period) as necessary so as to satisfy the relationships |Vbl-2|>|Vdv-2| and |Vdr-2|>|Vdv-2|.

Third Embodiment

Figure 18:
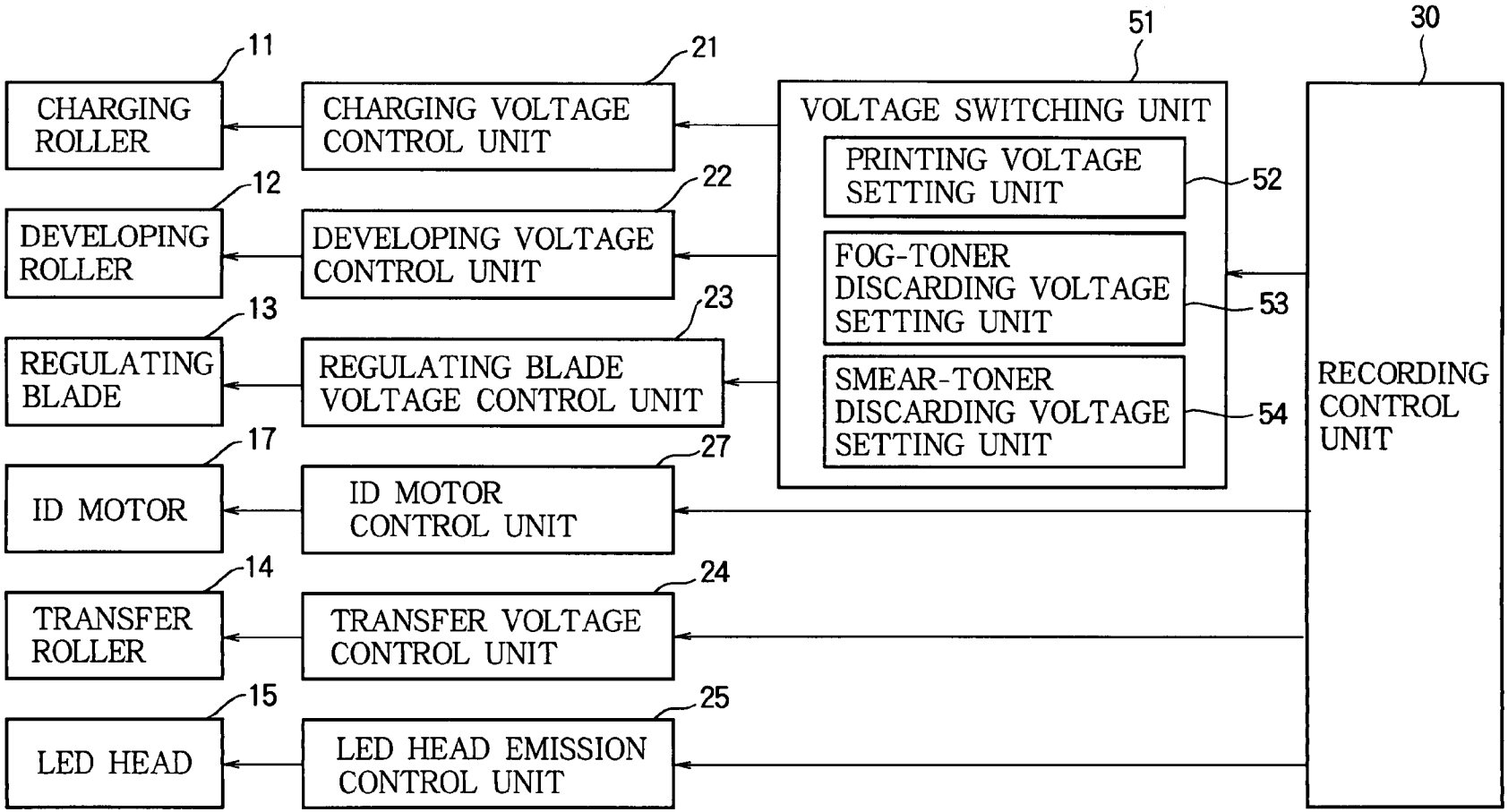
FIG. 18 is a block diagram showing a configuration of a control system of an image forming apparatus according to the third embodiment of the present invention.
Figures 19A, 19B, 19C, 19D, 19E, 19F:
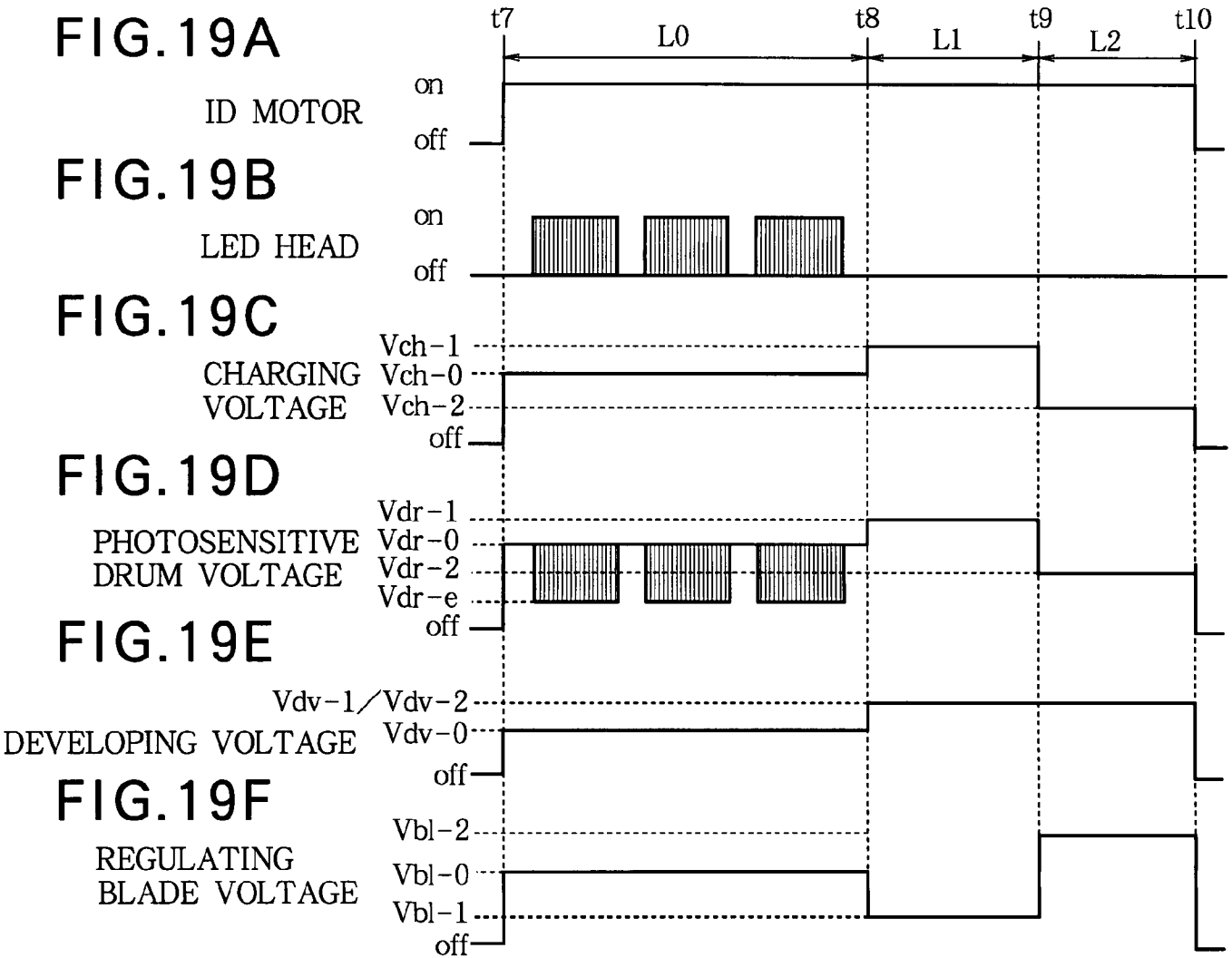
FIGS. 19A through 19F show a timing chart illustrating operation timings of respective parts according to the third embodiment of the present invention.

FIG. 18 is a block diagram of a control system of an image forming apparatus according to the third embodiment of the present invention. Components that are the same as those of the first or second embodiment are assigned the same reference numerals, and explanations thereof will be omitted. With regard to operations and advantages that are the same as those of the first or second embodiment, explanations thereof will be omitted.

In the third embodiment, the charging voltage control unit 21, the developing voltage control unit 22, the regulating blade control unit 23 are connected to a voltage switching unit 51. The voltage switching unit 51 includes a printing voltage setting unit 52, a fog-toner discarding voltage setting unit 53 and a smear-toner discarding voltage setting unit 54. According to the instruction from a recording control unit 30, the voltage switching unit 51 selects the voltages for printing period (held in the printing voltage setting unit 52), voltages for the fog-toner discarding period (held in the fog-toner discarding voltage setting unit 53) or voltages for the smear-toner discarding period (held in the smear-toner discarding voltage setting unit 54), which are notified to the charging voltage control unit 21, the developing voltage control unit 22 and the regulating blade voltage control unit 23. The charging voltage control unit 21, the developing voltage control unit 22 and the regulating blade voltage control unit 23 output voltages according to voltage settings notified by the voltage switching unit 51.

The other configurations are the same as the first embodiment, and therefore explanation thereof will be omitted.

Next, the operation of the image forming apparatus 100 will be described. The printing operation is the same as in the first and second embodiments, and therefore explanation thereof will be omitted.

In this embodiment, the charging voltage, the developing voltage and the regulating blade voltage are switched from the voltages for the printing period to the voltages for the fog-toner discarding period or the voltages for the smear-toner discarding period voltage, to thereby selectively discard the fog-toner or the smear-toner during a period other than the printing period.

The relationship between the photosensitive drum voltage, the developing voltage and the regulating blade voltage in the fog-toner discarding period are the same as that in the first embodiment. Further, the relationship between the photosensitive drum voltage, the developing voltage and the regulating blade voltage in the smear-toner discarding period are the same as that in the second embodiment. For these reasons, explanation of the voltage settings will be omitted.

Next, operation timings of the respective parts in the fog-toner discarding period and in the smear-toner discarding period will be described.

FIGS. 19A through 19F show a timing chart illustrating operation timings of the ID motor 17, the light emission of the LED head 15, the charging voltage, the photosensitive drum voltage, the developing voltage and the regulating blade voltage according to the third embodiment of the present invention.

First, a print job is started in response to a print job starting signal from the recording control unit 30, and the ID motor 17 is turned on (t7). This causes the photosensitive drum 1, the charging roller 11, the developing roller 12 and the toner supplying roller 18 to start rotating. The charging voltage Vch-0 for the printing period is applied to the charging roller 11 in synchronization with the starting of the rotation. By the application of the charging voltage Vch-0 for the printing period, the surface of the photosensitive drum 1 is charged to the photosensitive drum voltage Vdr-0 for the printing period. At the same time (at the timing t7), the developing voltage Vdv-0 for the printing period is applied to the developing roller 12, and the regulating blade voltage Vbl-0 for the printing period is applied to the regulating blade 13. With this, the printing period L0 is started.

Subsequently, the LED head 15 starts the light emitting operation according to page synchronization signal and image data. When the LED head 15 emits light, the electric potential of the irradiated area of the photosensitive drum 1 is lowered to a latent image potential Vdr-e, and a latent image is formed. The latent image is developed by the toner, with the result that the toner image is formed. When the LED 15 completes the light emitting operation, the printing period L0 ends (t8).

At the timing t8, the charging voltage is switched to the charging voltage Vch-1 for the fog-toner discarding period while the ID motor 17 is kept turned on. By the switching of the charging voltage, the photosensitive drum voltage is switched to the photosensitive drum voltage Vdr-1 for the fog-toner discarding period. Further, at the timing t8, the developing voltage is switched to the developing voltage Vdv-1 for the fog-toner discarding period, and the regulating blade voltage is switched to the regulating blade voltage Vbl-1 for the fog-toner discarding period. With this, the fog-toner discarding period (L1) is started. The fog-toner discarding period (L1) continues to a timing t9. During the fog-toner discarding period (L1), the light emission of the LED head 15 is turned off, and no latent image is formed on the photosensitive drum 1.

Further, at the timing t9, the charging voltage is switched to the charging voltage Vch-2 for the smear-toner discarding period while the ID motor 17 is kept turned on. By the switching of the charging voltage, the photosensitive drum voltage is switched to the photosensitive drum voltage Vdr-2 for the smear-toner discarding operation. Further, at the timing t8, the developing voltage is switched to the developing voltage Vdv-2 for the smear-toner discarding period, and the regulating blade voltage is switched to the regulating blade voltage Vbl-2 for the smear-toner discarding period. With this, the smear-toner discarding period (L2) is started. The smear-toner discarding period (L2) continues to a timing t10. At the timing t10, the ID motor 17, the charging voltage, the developing voltage, the photosensitive voltage and the regulating blade voltage are turned off. With this, the print job is completed, and an off-state continues until next print job is received. During the smear-toner discarding period (L2), the light emission of the LED head 15 is turned off, and no latent image is formed on the photosensitive drum 1.

Here, description has been made to an example where the developing voltage and the regulating blade voltage are switched at the same time as the charging voltage. However, a time delay can be provided therebetween corresponding to a time for the photosensitive drum 1 to rotate a distance between the charging roller 11 and the developing roller 12 along the circumference of the photosensitive drum 1.

As the fog-toner discarding period (L1) and the smear-toner discarding period (L2) are longer, the amounts of discarded fog-toner and smear-toner increase. However, as the fog-toner discarding period (L1) and the smear-toner discarding period (L2) are longer, the revolution of the photosensitive drum 1 increases, and therefore the lifetime of the photosensitive drum 1 is shortened and the printing throughput becomes low. Therefore, it is necessary to suitably adjust the lengths of the fog-toner discarding period (L1) and the smear-toner discarding period (L2) according to application of the image forming apparatus 100 or the like. It is preferable that each of the fog-toner discarding period (L1) and the smear-toner discarding period (L2) is longer than a sum of a time required for the developing roller 12 to rotate by one rotation and a time required for the toner supplying roller 18 to rotate by one rotation.

The description of the third embodiment is merely an example, and the respective voltages are not limited to those described above. The voltages can be set so as to effectively discard the fog-toner and the smear-toner, in accordance with process conditions (such as charge characteristics of the toner or properties of the respective rollers), environmental conditions (such as temperature or humidity), voltage output range of the power source, or the like.

Further, description has been made to an example in which the fog-toner discarding operation and the smear-toner discarding operation are performed when the printing operation ends during the print job. However, it is also possible to perform the fog-toner discarding operation and the smear-toner discarding operation before the printing operation starts during the print job. Alternatively, it is also possible to independently perform the fog-toner discarding operation and the smear-toner discarding operation between the print jobs. It is also possible to perform the fog-toner discarding operation and the smear-toner discarding operation for a short time on every print job. Furthermore, it is also possible to perform the fog-toner discarding operation and the smear-toner discarding operation once every 500 sheets of printing or the like. Moreover, it is also possible to provide a button to start the fog-toner discarding operation and the smear-toner discarding operation so that the fog-toner discarding operation and the smear-toner discarding operation are started by the operation by the user.

Further, although description has been made to an example in which the fog-toner discarding operation and the smear-toner discarding operation are successively performed, it is also possible to separately perform the fog-toner discarding operation and the smear-toner discarding operation at respective timings. For example, it is possible to perform the fog-toner discarding operation before the printing operation is started during the print job and perform the smear-toner discarding operation after the printing operation ends during the print job.

As described above, according to the third embodiment, the respective voltages are switched between the voltages for the printing period, the voltages for the fog-toner discarding period and the voltages for the smear-toner discarding period. To be more specific, the voltages for the fog-toner discarding period is set so as to increase the efficiency in discarding the low-charge toner and reversely-charged toner (existing in the developing unit 2) to the developing roller 12. The voltages for the smear-toner discarding period is set so as to increase the efficiency in discarding the high-charge toner and easily-chargeable toner (existing in the developing unit 2) to the developing roller 12. With this, the fog-toner and the smear-toner can be effectively discarded from the developing unit 2, and therefore it becomes possible to obtain a high quality image with no fog or smear.

In the above described first through third embodiments, examples in which the present invention is applied to the printer have been described. However, the present invention is applicable to an MFP (Multi Function Printer), a facsimile machine, a copier or the like.

Further, the present invention is applicable to, for example, a tandem type color printer that forms a color image with one cycle using four developing devices, and a four-cycle color printer that forms a color image with four cycles using an intermediate transfer belt.

Furthermore, the present invention is also applicable to single-component non-contact development or two-components development, as well as single-component contact development.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

a latent image bearing body that bears a latent image;

a charging member applied with a charging voltage and configured to charge a surface of said latent image bearing body;

a developer bearing body applied with a developing voltage and configured to develop said latent image by causing a developer to adhere to said latent image, and a developer regulating member applied with a regulating-member-application voltage and configured to form a layer of said developer on said developer bearing body, wherein, in a non-image-forming period, an absolute value of said regulating-member-application voltage is smaller than or equal to an absolute value of said developing voltage.

2. The image forming apparatus according to claim 1, wherein a polarity of said regulating-member-application voltage and a polarity of said developing voltage are the same as each other in said non-image-forming period.

3. The image forming apparatus according to claim 1, wherein, in a predetermined voltage-changing period provided in said non-image-forming period, said absolute value of said regulating-member-application voltage is smaller than or equal to said absolute value of said developing voltage.

4. The image forming apparatus according to claim 3, further comprising a voltage switching unit that switches at least one of said charging voltage and said developing voltage in said voltage-changing period.

5. The image forming apparatus according to claim 3, wherein, in said voltage-changing period, an absolute value of a surface voltage of said latent image bearing body is larger than said absolute value of said developing voltage.

6. The image forming apparatus according to claim 4, wherein, in said voltage-changing period, an absolute value of a surface voltage of said latent image bearing body is larger than said absolute value of said developing voltage.

7. The image forming apparatus according to claim 4, wherein said voltage switching unit switches said charging voltage.

8. An image forming apparatus comprising:

a latent image bearing body that bears a latent image;

a charging member applied with a charging voltage and configured to charge a surface of said latent image bearing body;

a developer bearing body applied with a developing voltage and configured to develop said latent image by causing a developer to adhere to said latent image, and a developer regulating member applied with a regulating-member-application voltage and configured to form a layer of said developer on said developer bearing body, wherein, in a non-image-forming period, an absolute value of said regulating-member-application voltage is larger than an absolute value of said developing voltage, and a difference between said regulating-member-application voltage and said developing voltage is larger than in an image forming period.

9. The image forming apparatus according to claim 8, wherein, in said non-image-forming period, said absolute value of said regulating-member-application voltage is larger than an absolute value of a surface voltage of said latent image bearing body.

10. The image forming apparatus according to claim 8, wherein, in a predetermined voltage-changing period in said non-image-forming period, said absolute value of said regulating-member-application voltage is larger than said absolute value of said developing voltage, and said difference between said regulating-member-application voltage and said developing voltage is larger than in said image forming period.

11. The image forming apparatus according to claim 10, further comprising a voltage switching unit that switches at least one of said charging voltage and said developing voltage for said voltage-changing period.

12. The image forming apparatus according to claim 10, wherein, in said voltage-changing period, an absolute value of a surface voltage of said latent image bearing body is larger than said absolute value of said developing voltage, and a difference between said surface voltage of said latent image bearing member and said developing voltage is smaller than in said image forming period.

13. The image forming apparatus according to claim 10, wherein, in said voltage-changing period, said absolute value of said regulating-member-application voltage is larger than an absolute value of a surface voltage of said latent image bearing body.

14. The image forming apparatus according to claim 12, wherein, in said voltage-changing period, said absolute value of said regulating-member-application voltage is larger than said absolute value of said surface voltage of said latent image bearing body.

15. An image forming apparatus comprising, a latent image bearing body that bears a latent image;

a charging member applied with a charging voltage and configured to charge a surface of said latent image bearing body;

a developer bearing body applied with a developing voltage and configured to develop said latent image by causing a developer to adhere to said latent image;

a developer regulating member applied with a regulating-member-application voltage and configured to form a layer of said developer on said developer bearing body; and a voltage switching unit configured to switch said regulating-member-application voltage, wherein, in a non-image-forming period, said voltage switching unit switches said regulating-member-application voltage from a voltage set for an image forming period to a different voltage, and wherein said voltage switching unit performs switching of said regulating-member-application voltage, in a predetermined voltage-changing period provided in said non-image-forming period, and wherein a fog-causing developer is discarded in said voltage-changing period.

16. The image forming apparatus according to claim 15, wherein said voltage switching unit further switches at least one of said charging voltage and said developing voltage in said voltage-changing period.

17. An image forming apparatus comprising, a latent image bearing body that bears a latent image;

a charging member applied with a charging voltage and configured to charge a surface of said latent image bearing body;

a developer bearing body applied with a developing voltage and configured to develop said latent image by causing a developer to adhere to said latent image;

a developer regulating member applied with a regulating-member-application voltage and configured to form a layer of said developer on said developer bearing body; and a voltage switching unit configured to switch said regulating-member-application voltage, wherein, in a non-image-forming period, said voltage switching unit switches said regulating-member-application voltage from a voltage set for an image forming period to a different voltage, and wherein said voltage switching unit performs switching of said regulating-member-application voltage, in a predetermined voltage-changing period provided in said non-image-forming period, and wherein a smear-causing developer is discarded in said voltage-changing period.

18. The image forming apparatus according to claim 17, wherein said voltage switching unit further switches at least one of said charging voltage and said developing voltage in said voltage-changing period.

* * * * *